US006069965A

United States Patent [19]

Takewa et al.

[11] Patent Number: 6,069,965

[45] Date of Patent: May 30, 2000

[54] LOUDSPEAKER

[75] Inventors: Hiroyuki Takewa, Kaizuka; Kazue Satoh, Neyagawa; Mikio Iwasa, Katano; Tohru Kikkawa, Hirakata, all of Japan

[73] Assignee: Matsushita Electric Industrial Co., Ltd., Kadoma, Japan

[21] Appl. No.: 08/946,401

[22] Filed: Oct. 7, 1997

[30] Foreign Application Priority Data

Oct. 9, 1996 [JP] Japan ..... 8-268280
Jun. 9, 1997 [JP] Japan ..... 9-150791

[51] Int. Cl.[7] ..... H04R 25/00

[52] U.S. Cl. ..... 381/404; 381/403

[58] Field of Search ..... 381/403, 404, 381/FOR 157; 181/171, 172

[56] References Cited

U.S. PATENT DOCUMENTS

| | | | |
|---|---|---|---|
| 1,750,009 | 3/1930 | Jensen | 381/404 |
| 1,944,725 | 1/1934 | Tenny | 381/404 |
| 2,019,878 | 11/1935 | Tolerton | 381/40 |
| 2,112,473 | 3/1938 | Tolerton | 381/404 |
| 4,239,944 | 12/1980 | Obara et al. | 381/404 |
| 5,511,131 | 4/1996 | Kohara et al. | 381/192 |
| 5,619,019 | 4/1997 | Yoshimura et al. | 181/166 |
| 5,790,682 | 8/1998 | Hachiya et al. | 381/404 |

FOREIGN PATENT DOCUMENTS

| | | |
|---|---|---|
| 60-200700 | 10/1985 | Japan . |
| 5103395 | 4/1993 | Japan . |

OTHER PUBLICATIONS

K. Satoh et al., IEEE Transactions on Consumer Electronics, vol. 43, No. 3, pp. 972–979, 1997, "A High Fidelity Small–Sized Loudspeaker."

*Primary Examiner*—Curtis A. Kuntz
*Assistant Examiner*—Phylesha Dabney
*Attorney, Agent, or Firm*—Renner, Otto, Boisselle & Sklar

[57] ABSTRACT

The loudspeaker includes: a frame; a magnetic circuit portion; a diaphragm transmitting air vibration; a cylindrical voice coil bobbin connected to the diaphragm; a voice coil fixed to an outer peripheral portion of the voice coil bobbin; and a damper holding the voice coil in such a manner that the voice coil is capable of vibrating in a magnetic gap formed between an annular top plate and a center pole included in the magnetic circuit portion. The damper includes a flat portion which has a hole for passing the voice coil bobbin therethrough at its center, and a plurality of roll structures connected to a periphery of the flat portion and having a cross-section including a bent periphery. Each of the plurality of roll structures is fixed to the frame, and the hole of the flat portion is fixed to an outer peripheral surface of the voice coil bobbin.

19 Claims, 20 Drawing Sheets

LOUDSPEAKER

BACKGROUND OF THE INVENTION

1. Field of the Invention

The present invention relates to a small-sized loudspeaker capable of reproducing a large sound input signal.

2. Description of the Related Art

In recent years, small-sized sound reproduction apparatuses occupying less space have been used. Most loudspeakers used in such sound reproduction apparatuses are small in diameter. A conventional small-sized loudspeaker is provided with a diaphragm having a small diameter. Therefore, the vibration amplitude of the diaphragm is required to be increased in inverse proportion to the area of the diaphragm and to the square of the intensity of the sound signal to be produced in order to obtain a predetermined sound pressure.

A conventional loudspeaker has a structure in which a damper, or a suspension, supporting a diaphragm is generally made of fibers impregnated with resin and has a corrugated cross-section of a number of concentric circles. The damper with such a structure (i.e., the corrugation damper) should be displaced in such a manner that the corrugations of the damper are stretched when the diaphragm is vibrated. In this case, as the amplitude of the diaphragm of the damper becomes larger, the radius of each concentric circle of the damper should be changed (increased) more widely.

In the conventional damper, vertexes of the corrugations are concentrically positioned. Thus, there is no mechanism by which the radius of the corrugations of the damper may increase in accordance with the increase in amplitude of the vibration of the diaphragm. In order to realize a predetermined large amplitude of the diaphragm, the material constituting the damper is required to have sufficient circumferential stretch/shrinkage properties.

However, the fibers impregnated with resin which are typical materials for the damper generally stretch less because of their small elasticity. Thus, sufficient change in radius of the corrugations cannot be obtained. This limits the obtainable magnitude of a feasible amplitude, making it impossible to obtain a sufficiently large amplitude. Therefore, it is difficult in the conventional small-sized loudspeaker to obtain a very large amplitude particularly when a sound signal in a low frequency region is reproduced.

As described above, the conventional small-sized loudspeaker has a structure in which the damper is unlikely to be deformed to such a degree as to allow the diaphragm to vibrate at a large amplitude, which makes it impossible to reproduce a sound signal with a large electric power. In particular, bass reproduction characteristics are poor, increasing the distortion of a reproduced signal.

SUMMARY OF THE INVENTION

A loudspeaker of this invention includes: a frame; a magnetic circuit portion; a diaphragm transmitting air vibration; a cylindrical voice coil bobbin connected to the diaphragm; a voice coil fixed to an outer peripheral portion of the voice coil bobbin; and a damper holding the voice coil in such a manner that the voice coil is capable of vibrating in a magnetic gap formed between an annular top plate and a center pole included in the magnetic circuit portion. The damper includes a flat portion which has a hole for passing the voice coil bobbin therefore at its center, and a plurality of roll structures connected to a periphery of the flat portion and having a cross-section including a bent periphery. Each of the plurality of roll structures is fixed to the frame, and the hole of the flat portion is fixed to an outer peripheral surface of the voice coil bobbin.

In one embodiment, the damper is made of natural fibers or synthetic fibers impregnated with resin, and the impregnating concentration of the resin in each of the plurality of roll structures changes from the side closer to the flat portion to the side closer to the frame.

In another embodiment, the loudspeaker further includes a plurality of projections in the shape of a triangular pyramid provided along the periphery of the hole of the flat portion.

In still another embodiment, the radius of the cross-section including the bent periphery of each of the plurality of roll structures changes in the central axis direction of each of the roll structures.

In still another embodiment, the cross-section of each of the plurality of roll structures includes straight portions at the ends of a semi-circular portion.

In still another embodiment, the cross-section of each of the plurality of roll structures is in the shape of a semi-oval.

In still another embodiment, the plurality of roll structures include two kinds of structures whose cross-sectional radius is different from each other, and the two kinds of structures are disposed alternately along a periphery of the flat portion.

According to another aspect of the invention, a loudspeaker includes: a frame; a magnetic circuit portion; a diaphragm transmitting air vibration; a cylindrical voice coil bobbin connected to the diaphragm; a voice coil fixed to an outer peripheral portion of the voice coil bobbin; and a damper holding the voice coil in such a manner that the voice coil is capable of vibrating in a magnetic gap formed between an annular top plate and a center pole included in the magnetic circuit portion. The damper includes a plurality of arc-shaped spring members, one end of the spring members being fixed to the outer peripheral portion of the voice coil bobbin, and the other end of the spring members being fixed to the frame.

Each of the plurality of spring members of the damper may be made of a polymer resin wire or a piano wire.

In one embodiment, the damper includes: an annular voice coil bobbin attachment portion fixed to the outer peripheral portion of the voice coil bobbin; and an annular frame attachment portion fixed to the frame, and each of the plurality of spring members is provided to connect the voice coil bobbin attachment portion with the frame attachment portion in a radius direction of the voice coil bobbin.

The damper may further include a connecting member connecting the plurality of spring members in a direction parallel to an outer periphery of the voice coil bobbin.

The voice coil bobbin attachment portion, the frame attachment portion, the plurality of spring members, and the connecting member may be integrally molded with elastic resin.

The connecting member may be formed with a connected plurality of arc portions having an identical pitch with an arrangement interval of the plurality of spring members.

In one embodiment, the damper further includes a voice coil bobbin attachment plate attached to the outer peripheral portion of the voice coil bobbin, and the plurality of spring members are provided so as to connect a periphery of the voice coil bobbin attachment plate to the frame.

The damper may further include a connecting member connecting the plurality of spring members.

The plurality of spring members and the connecting member may be integrally molded with elastic resin.

According to still another aspect of the invention, a loudspeaker includes: a frame; a magnetic circuit portion; a diaphragm transmitting air vibration; a cylindrical voice coil bobbin connected to the diaphragm; a voice coil fixed to an outer peripheral portion of the voice coil bobbin; and a damper holding the voice coil in such a manner that the voice coil is capable of vibrating in a magnetic gap formed between an annular top plate and a center pole included in the magnetic circuit portion. The damper includes a voice coil bobbin attachment plate in the shape of a polygon attached to the outer peripheral portion of the voice coil bobbin. A plurality of spring structures, one end of each being connected to the voice coil bobbin attachment plate, and attachment chips supported by the frame and connected to the other ends of the plurality of spring members.

In one embodiment, each of the plurality of spring structures is a connected body of a viscoelastic member and an elastic member which is capable of stretching and shrinking.

According to still another aspect of the invention, a loudspeaker includes: a frame; a magnetic circuit portion; a diaphragm transmitting air vibration; a cylindrical voice coil bobbin connected to the diaphragm; a voice coil fixed to an outer peripheral portion of the voice coil bobbin; and a damper holding the voice coil in such a manner that the voice coil is capable of vibrating in a magnetic gap formed between an annular top plate and a center pole included in the magnetic circuit portion. The damper includes: a roll damper in which roll structures having an arc-shaped cross-section and a voice coil bobbin attachment plate on a flat surface are integrally molded; and a circular corrugation damper in which a sheet having bending elasticity whose outer periphery is fixed to the frame and inner periphery is connected to the roll structures is molded in a concentric waveform.

According to still another aspect of the invention, a loudspeaker includes: a frame; a magnetic circuit portion; a diaphragm transmitting air vibration; a cylindrical voice coil bobbin connected to the diaphragm; a voice coil fixed to an outer peripheral portion of the voice coil bobbin; and a damper holding the voice coil in such a manner that the voice coil is capable of vibrating in a magnetic gap formed between an annular top plate and a center pole included in the magnetic circuit portion. The damper includes: a circular corrugation damper in which a sheet having bending elasticity is molded in a concentric waveform; an inner annular member and an outer annular member having different radii; and a plurality of arc-shaped spring members connecting the inner annular member to the outer annular member in a radius direction. The inner annular member is fixed to the outer peripheral portion of the voice coil bobbin. The outer annular member is connected to an inner peripheral portion of the corrugation damper. And an outer peripheral portion of the corrugation damper is fixed to the frame.

Thus, the invention described herein makes possible the advantage of providing a damper having a structure allowing a diaphragm to vibrate at a large amplitude, thereby realizing a loudspeaker having outstanding bass reproduction characteristics and less distortion.

This and other advantages of the present invention will become apparent to those skilled in the art upon reading and understanding the following detailed description with reference to the accompanying figures.

DESCRIPTION OF THE PREFERRED EMBODIMENTS

Embodiment 1

A loudspeaker in Embodiment 1 of the present invention will be described by illustrating a structure of a damper included in the loudspeaker with reference to FIGS. 1 through 4.

Figure 1:
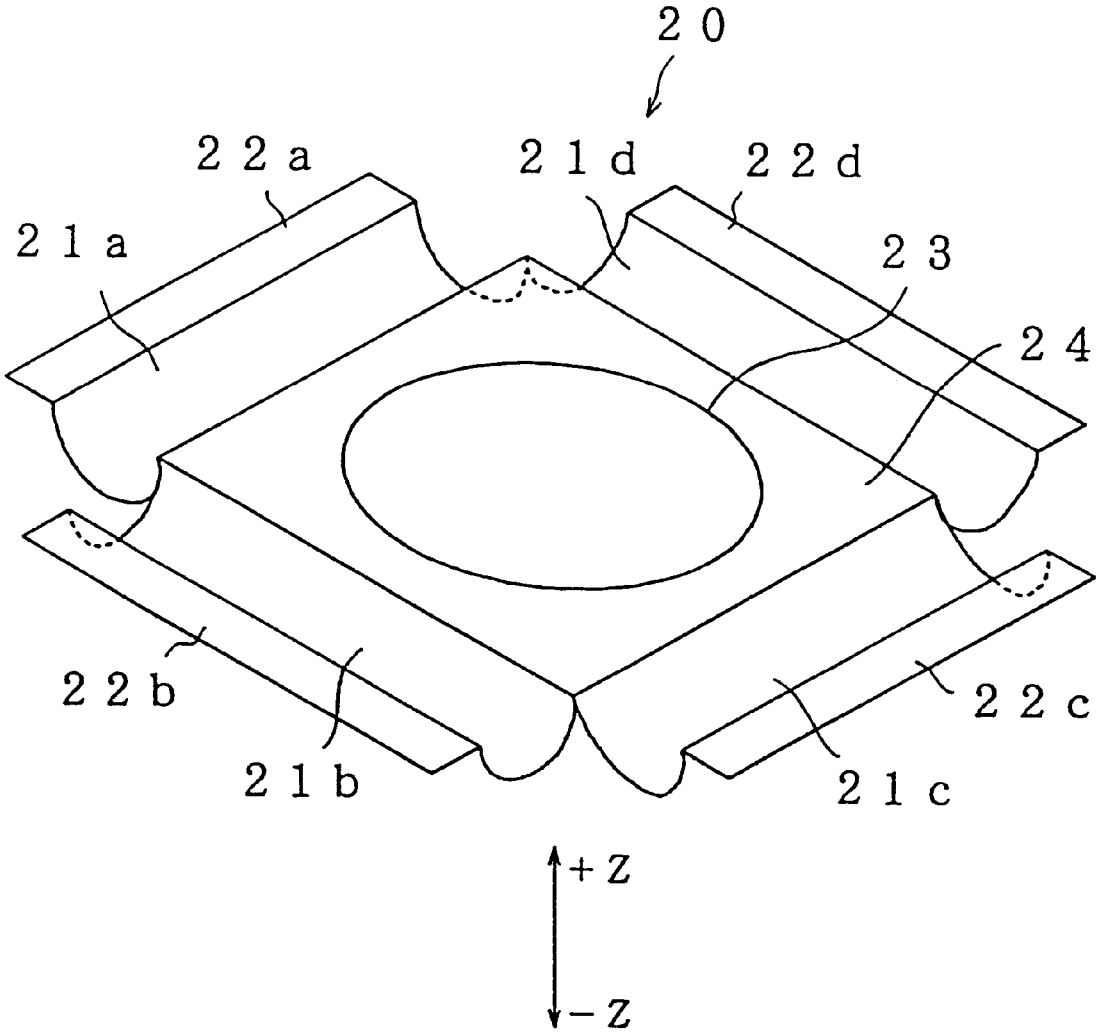
FIG. 1 is a perspective view showing a structure of a damper of a loudspeaker in Embodiment 1 of the present invention.

FIG. 1 is a perspective view showing a structure of a damper, or suspension, 20 used in a loudspeaker in Embodiment 1 of the present invention.

The damper 20 is a substantially square member which includes a flat portion 24 positioned in the center, roll structures 21*a* through 21*d* (collectively denoted by the reference numeral 21) provided on four sides of the flat portion 24, and plate-shaped attachment chips 22*a* through 22*d* (collectively denoted by the reference numeral 22) provided opposite to the flat portion 24 with respect to the roll structures 21*a* through 21*d*. The flat portion 24 has a circular hole 23 at its center for allowing a voice coil bobbin (member denoted by the reference numeral 8 in FIG. 2) to pass through. The periphery of the hole 23 (see FIG. 1) is bonded to an outer peripheral surface of the voice coil bobbin 8 with an adhesive.

Assuming that the vibration direction of the voice coil bobbin 8 is the Z-axis direction, the front of the loudspeaker is positioned in the +Z direction, and the back of the loudspeaker is positioned in the −Z direction, four roll structures 21*a* through 21*d* are elastic members having an identical semi-circular cross-section which is convex in the −Z direction. The respective roll structures 21*a* through 21*d* are typically made of natural/synthetic fibers impregnated with resin.

The four attachment chips 22*a* through 22*d* are attached to an attachment surface of a frame (denoted by the reference numeral 2 in FIG. 2) so as to be positioned at an identical height with that of the flat portion 24.

The flat portion 24 and the attachment chips 22 can be formed of thin aluminum foil or kraft paper. Alternatively, the flat portion 24 and the attachment chips may be integrally formed with the roll structures 21 using an identical material (e.g., natural/synthetic fibers impregnated with resin). In this case, the strength of the flat portion 24 and the attachment chips 22 is reinforced by increasing the amount of impregnating resin therein or by additionally bonding thin aluminum foil or kraft paper to the fibers impregnated with resin, whereby the flatness of the flat portion 24 and the attachment chips 22 is kept with respect to vibration.

Figure 2:
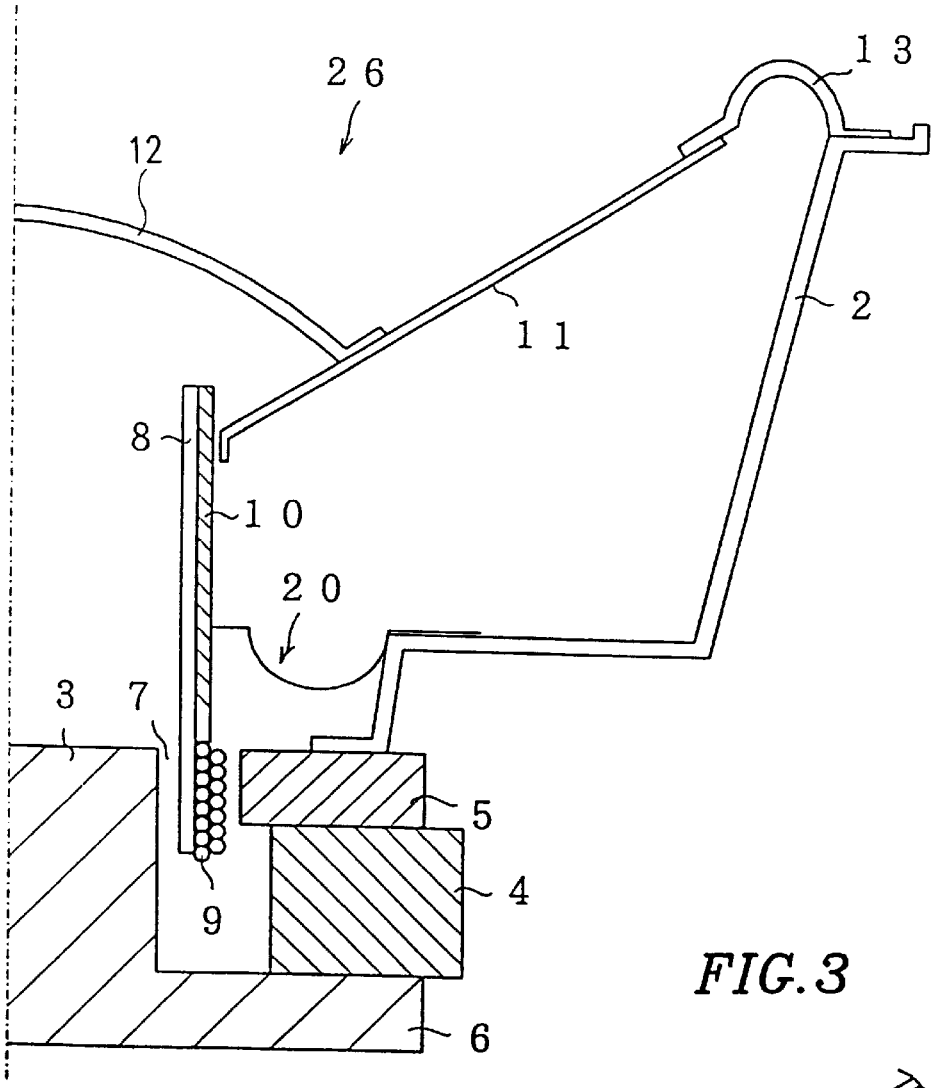
FIG. 2 is a partial cross-sectional view showing a structure of the loudspeaker in Embodiment 1 of the present invention.

FIG. 2 is a half cross-sectional view showing a structure of a loudspeaker 26 in the present embodiment including the damper 20 shown in FIG. 1.

In the loudspeaker 26, an annular magnetic circuit 6 including a center pole 3, a magnet 4, and a top plate 5 is formed at a lower end of the annular frame 2. A high density magnetic flux is generated in an annular gap 7 formed between an upper outer periphery of the center pole 3 and an inner periphery of the top plate 5. The voice coil bobbin 8 is held by the damper 20 so as to vibrate vertically in the gap 7. The voice coil bobbin 8 is generally a member formed of thin paper in a cylindrical shape, and an outer periphery at a lower end thereof is wound with a voice coil 9.

The voice coil 9 is made of a wire such as aluminum and copper. When receiving a driving current of a sound signal, the voice coil 9 generates an electromagnetic force to vibrate the voice coil bobbin 8 vertically. The outer periphery excluding the lower end of the voice coil bobbin 8 is wound with reinforcing paper 10, whereby the stiffness of the voice coil bobbin 8 is secured.

The damper 20 is directly fixed to the vicinity of a center of the voice coil bobbin 8, and a diaphragm 11 is attached to the vicinity of an upper end thereof. The diaphragm 11 is attached to the vicinity of an upper end of the frame 2 through an edge 13. Furthermore, the diaphragm 11 is provided with a cover 12 for preventing dust and the like from entering the annular magnetic circuit 6.

In the loudspeaker 26 having the above-mentioned structure, when a driving current in proportion to the intensity of the sound signal flows through the voice coil 9, the driving current and the magnetic flux in the gap 7 generate an electromagnetic force, vibrating the voice coil bobbin 8 vertically (i.e., in the Z-axis direction). This vibrates the diaphragm 11 to generate a sound. The damper 20 and the edge 13 elastically support the vibration (reciprocating motion) of the diaphragm 11.

Figure 3:
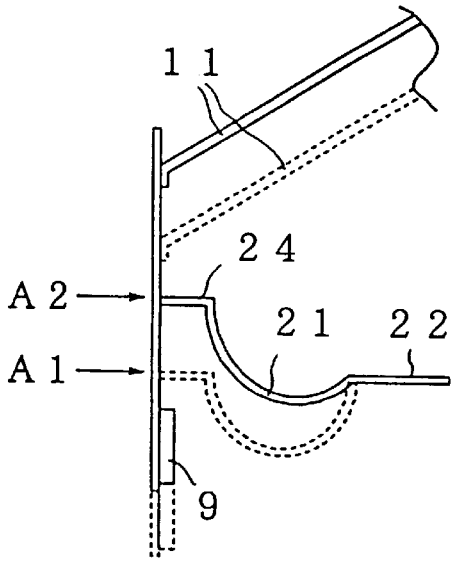
FIG. 3 is a partial cross-sectional view showing a displaced state of the damper in Embodiment 1 of the present invention.

FIG. 3 schematically shows a state of the damper 20 when a driving current is applied to the voice coil 9, and the voice coil bobbin 8 and the diaphragm 11 vibrate in the +Z direction from a state represented by a dotted line to a state represented by a solid line.

The flat portion 24 of the damper 20 is displaced integrally with the voice coil bobbin 8 since it is fixed to the outer periphery of the voice coil bobbin 8. The attachment chip 22 is not displaced as being fixed to the frame 2. The roll structure 21 present between the attachment chip 22 and the flat portion 24 is displaced from a position A1 to a position A2 due to the vibration to support the vibration displacement of the diaphragm 11.

Herein, the roll structures 21*a* through 21*d* are disposed straight so as to be elastically independent from each other. Therefore, the deformation of the roll structures 21*a* through 21*d* does not involve circumferential stretch/shrinkage of a material as in the conventional corrugation damper. This allow force-displacement characteristics having outstanding linearity to be obtained, making it possible to increase the maximum amplitude of the flat portion 24.

Figure 4:
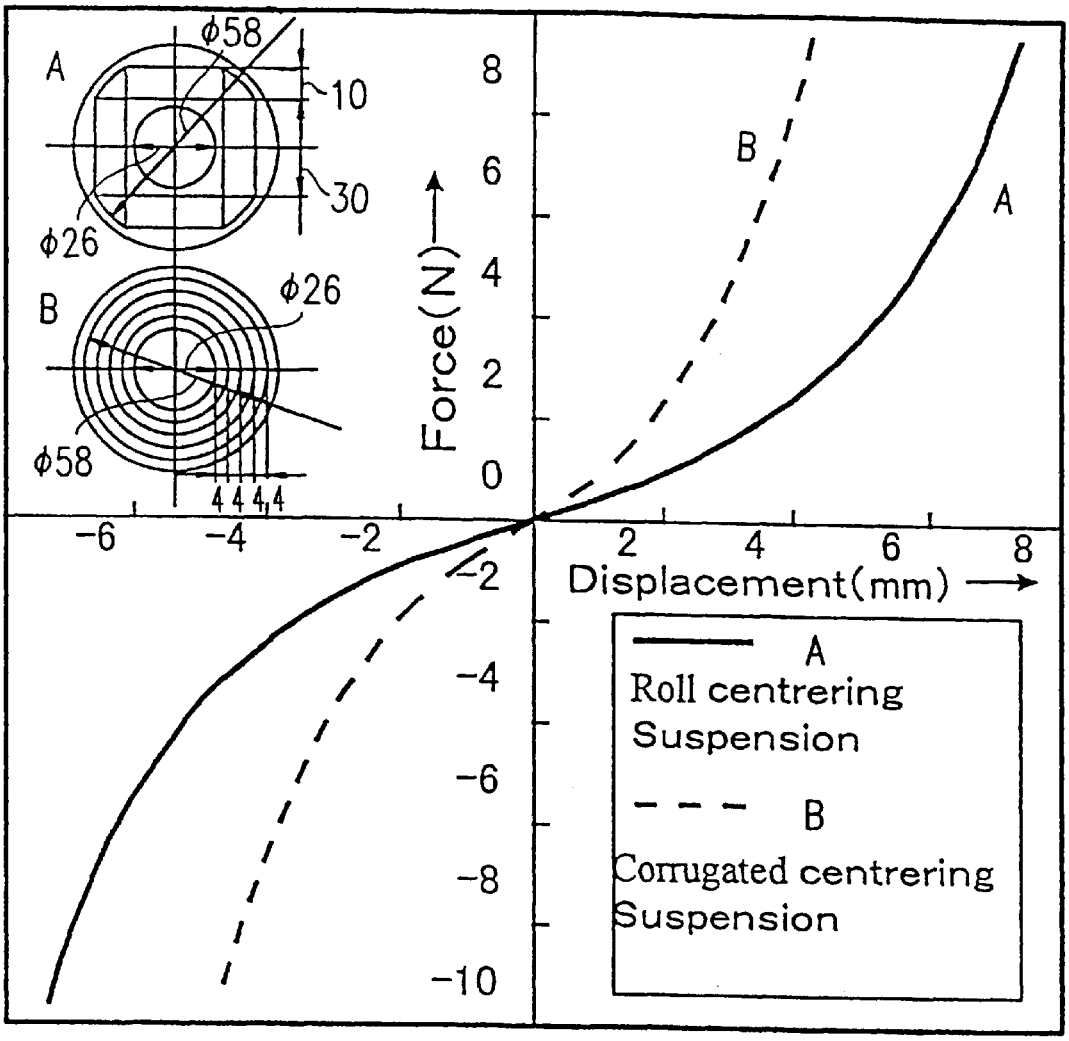
FIG. 4 shows force-displacement characteristics of the damper in Embodiment 1 of the present invention.

FIG. 4 shows the results of analysis of the force-displacement characteristics of two types of dampers (suspensions) having different shapes but an identical attachment diameter by the finite element method (FEM).

More specifically, a roll centering damper (suspension) A in FIG. 4 corresponds to the damper having roll structures of the present invention, and a corrugated centering damper (suspension) B in FIG. 4 is a conventional corrugation damper. In both of the roll centering suspension A and the corrugated centering suspension B, the diameter at the time of attachment is 56 mm, and the diameter of the voice coil is 26 mm. The roll centering suspension A is provided with four roll structures each having a radius of 5 mm. In the corrugated centering suspension B, four corrugations with a height of 2 mm and a width of 2 mm are concentrically disposed. Materials and other structural conditions are the same in the roll centering suspension A and the corrugated centering suspension B.

As shown in FIG. 4, the roll centering suspension A has the maximum amplitude larger than that of the corrugated centering suspension B. The roll centering suspension A also has the more desirable linearity of force-displacement characteristics compared with that of the corrugated centering suspension B. Furthermore, the ratio of displacement and force, i.e., stiffness (spring constant) of the roll centering suspension A becomes about a half that of the corrugated centering suspension B. Because of such low stiffness, in the loudspeaker of the present invention, the minimum resonance frequency can be decreased irrespective of a small diameter, and a bass with a lower frequency can be produced.

In the above description, the flat portion 24 is in the shape of a square. However, the flat portion 24 may be in the shape of a polygon (triangle or more) or a circle as long as the sufficiently large hole 23 is secured.

The roll structures included in the damper in accordance with the present invention do not involve circumferential stretch/shrinkage of the constituting material upon reciprocating motion of the diaphragm since they are provided separately in a circumferential direction of the voice coil bobbin. As a result, the roll shape can be easily deformed to provide a large vibration amplitude, resulting in force-displacement characteristics having outstanding linearity. Thus, the loudspeaker with desirable reproducing characteristics of a bass sound signal with less distortion can be realized.

Embodiment 2

A loudspeaker in Embodiment 2 of the present invention will be described by illustrating a structure of a damper included in the loudspeaker with reference to FIG. 5.

Figure 5:
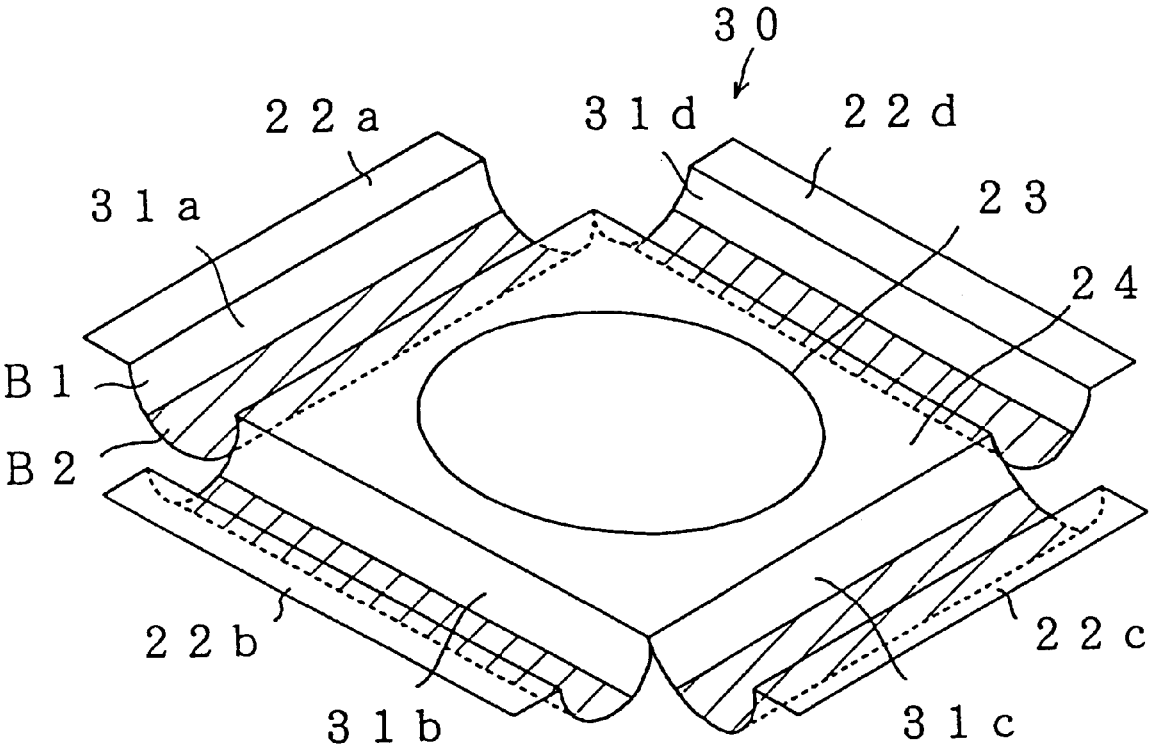
FIG. 5 is a perspective view showing a structure of a damper of a loudspeaker in Embodiment 2 of the present invention.

FIG. 5 is a perspective view showing a structure of a damper (suspension) 30 used in a loudspeaker in Embodiment 2 of the present invention. An outer shape of the damper 30 is substantially the same as that of the damper 20 in Embodiment 1 shown in FIG. 1. The damper 30 is different from the damper 20 in the configuration of the roll structures. The components identical with those in FIG. 1 are denoted by the reference numerals identical with those therein, and the description thereof will be omitted here.

More specifically, four roll structures 31*a* through 31*d* are elastic members having an identical semi circular cross-section which is convex in the -Z direction. Each roll structure 31 is typically made of natural/synthetic fibers impregnated with resin. The impregnating concentration of resin in a region B1 is different from that in the hatched region B2 shown in FIG. 5, and specifically, the impregnating concentration in the region B2 closer to the flat portion 24 is lower.

Four attachment chips 22*a* through 22*d* are attached to an attachment surface of the frame so as to be positioned at an identical height with that of the flat portion 24. The periphery of the hole 23 of the flat portion 24 is bonded to an outer peripheral surface of a voice coil bobbin with an adhesive.

The flat portion 24 and the attachment chips 22 can be formed of thin aluminum foil or kraft paper. Alternatively, the flat portion 24 and the attachment chips 22 may be integrally formed with the roll structures 31 using an identical material. In this case, the strength of the flat portion 24 and the attachment chips 22 is reinforced by increasing the amount of impregnating resin or by additionally bonding thin aluminum foil or kraft paper to the fibers impregnated with resin, whereby the flatness of the flat portion 24 and the attachment chips 22 is kept with respect to vibration.

The structure of the loudspeaker in the present embodiment including the damper 30 shown in FIG. 5 is substantially the same as that described with reference to FIG. 2. Therefore, the description thereof will be omitted here.

In the damper 30 having the structure as shown in FIG. 5, the roll structure 31 includes two regions B1 and B2 having different impregnating concentrations of resin, whereby the region B1, whose impregnating concentration of resin is lower, is softer than the region B2.

Generally, when an audible sound signal is applied to a loudspeaker, a diaphragm, an edge, a damper, and the like may resonate. The amplitudes and frequencies of these resonances are determined by the shape and material of each member as well as interconnection conditions between the members. In the damper 50 in the present embodiment, the stiffness of the region B1 of the roll structure 31 is different from that of the region B2. This allows the resonance frequency to be dispersed into two frequencies. Therefore, even when resonance is generated, the amplitude of the resonance of the damper 30 is small, not adversely affecting the vibration of the diaphragm.

Embodiment 3

A loudspeaker in Embodiment 3 of the present invention will be described by illustrating the structure of a damper included in the loudspeaker with reference to FIG. 6.

Figure 6:
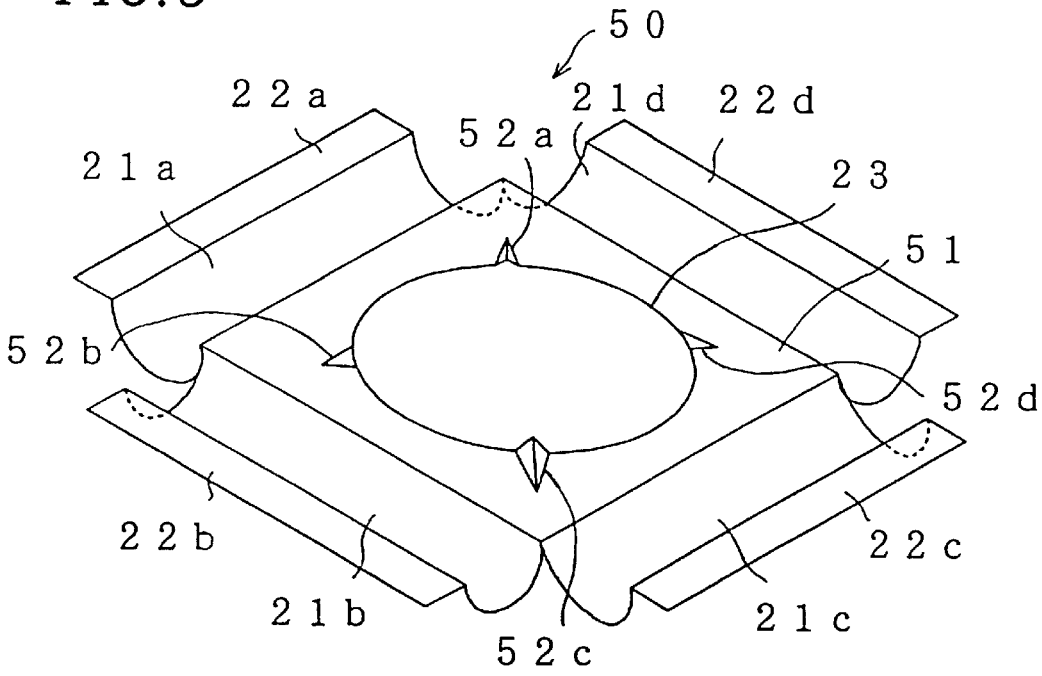
FIG. 6 is a perspective view showing a structure of a damper of a loudspeaker in Embodiment 3 of the present invention.

FIG. 6 is a perspective view showing the structure of a damper (suspension) 50 used in the loudspeaker in Embodiment 3 of the present invention. The outer shape of the damper 50 is substantially the same as that of the damper 20 in Embodiment 1 shown in FIG. 1 except for a flat portion 51. The components identical with those in FIG. 1 are denoted by the reference numerals identical with these therein, and the description thereof will be omitted here.

More specifically, the periphery of the hole 23 of the flat portion 51 of the damper 50 is provided with projections 52*a* through 52*d* in the shape of a triangular pyramid. The other structure is the same as that of the damper 20 in Embodiment 1. Four roll structures 21*a* through 21*d* are elastic members having an identical semi-circular cross-section which is convex in the -Z direction. Each roll structure 31 is made of natural/synthetic fibers impregnated with resin.

The flat portion 51 and the attachment chips 22 can be formed of thin aluminum foil or kraft paper. Alternatively, the flat portion 51 and the attachment chips 22 may be integrally formed with the roll structures 21 using an identical material. In this case, the strength of the flat portion 51 and the attachment chips 22 is reinforced by increasing the amount of impregnating resin or by additionally bonding thin aluminum foil or kraft paper to the fibers impregnated with resin, whereby the flatness of the flat portion 51 and the attachment chips 22 is kept with respect to vibration.

Four attachment chips 22*a* through 22*d* are attached to an attachment surface of a frame so as to be positioned at an identical height with that of the flat portion 51. The periphery of the hole 23 of the flat portion 51 is bonded to an outer peripheral surface of a voice coil bobbin with an adhesive.

At this time, ends of the projections 52*a* through 52*d* hold the outer peripheral surface of the voice coil bobbin, so that the straightness between the damper 50 and the voice coil bobbin can be easily secured. If the projections 52*a* through 52*d* are formed in such a manner that the projecting directions thereof are alternately inverted with respect to the flat portion 51, the bonding strength of the projections 52*a* through 52*d* with respect to the voice coil bobbin is improved.

The structure of the loudspeaker in the present embodiment including the damper 50 shown in FIG. 6 is substantially the same as that described with reference to FIG. 2. Therefore, the description thereof will be omitted here.

The damper 50 as shown in FIG. 6 has a structure in which the bonding area between the voice coil bobbin and the flat portion 51 increases in the vibration direction (i.e., in the Z-axis direction shown in FIG. 2). This prevents the voice coil bobbin from tilting due to rolling, improving the rolling strength.

Embodiment 4

A loudspeaker in Embodiment 4 of the present invention will be described by illustrating the structure of a damper included in the loudspeaker with reference to FIG. 7.

Figure 7:
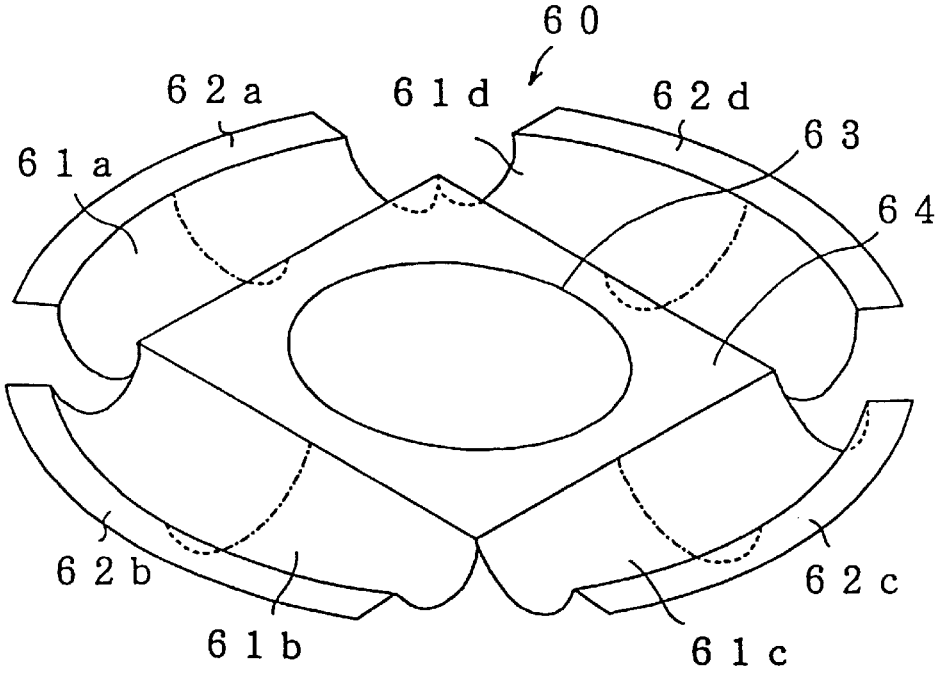
FIG. 7 is a perspective view showing a structure of a damper of a loudspeaker in Embodiment 4 of the present invention.

FIG. 7 is a perspective view showing the structure of a damper (suspension) 60 used in the loudspeaker in Embodiment 4 of the present invention.

The damper 60 is a substantially square member which includes a square flat portion 64 positioned in the center, roll structures 61*a* through 61*d* (collectively denoted by the reference numeral 61) provided on four sides of the flat portion 64, and plate-shaped attachment chips 62*a* through 62*d* (collectively denoted by the reference numeral 62) provided opposite to the flat portion 64 with respect to the roll structures 61*a* through 61*d*. The flat portion 64 has a circular hole 63 at its center for allowing a voice coil bobbin (denoted by reference numeral 8 in FIG. 2) to pass through. A periphery of the hole 63 of the flat portion 64 is bonded to an outer peripheral surface of the voice coil bobbin 8 with an adhesive.

In the structure of the damper 60 of the present embodiment, the roll structures 61*a* through 61*d* have an identical semi-circular cross-section. However, as for each of the roll structures 61*a* through 61*d*, the cross-sectional shape of these structures gradually changes in a circumferential direction of the flat portion 64. More specifically, each of the roll structures 61*a* through 61*d* has a larger radius of curvature in the vicinity of the center and a smaller radius of curvature at the ends. This provides the transition from the flat portion 64 to the generally round shape of the attachment chips 62*a* through 62*d*.

Four attachment chips 62*a* through 62*d* are attached to an attachment surface of a frame (member denoted by the reference numeral 2 in FIG. 2) so as to be positioned at an identical height with that of the flat portion 64. In the structure of the damper 60 in the present embodiment, each of the attachment chips 62*a* through 62*d* is formed in the shape of an arc, so that the attachment chips 62*a* through 62*d* are attached to the frame in an annular shape.

The flat portion 64 and the attachment chips 62 can be formed of thin aluminum foil or kraft paper. Alternatively, the flat portion 64 and the attachment chips 62 may be integrally formed with the roll structures 61 using an identical material (e.g., natural/synthetic fibers impregnated with resin). In this case, the strength of the flat portion 64 and the attachment chips 62 is reinforced by increasing the amount of impregnating resin or by additionally bonding thin aluminum foil or kraft paper to the fibers impregnated with resin, whereby the flatness of the flat portion 64 and the attachment chips 62 is kept with respect to vibration.

The structure of the loudspeaker in the present embodiment including the damper 60 in FIG. 7 is substantially the same as that described with reference to FIG. 2. Therefore, the description thereof will be omitted here.

In the damper 60 having the structure as shown in FIG. 7, the cross-sectional shape of each of the roll structures 61*a* through 61*d* gradually changes in a circumferential direction of the flat portion 64, whereby winding lengths of roll structures 61*a* through 61*d* are varied depending upon the location. Accordingly, the resonance of the damper 60 at a particular frequency determined by the shape of the roll structures 61*a* through 61*d* is dispersed at a plurality of resonance frequencies rather than at a single resonance frequency. Therefore, even when resonance is generated, the amplitude of the resonance of the damper 60 is small, not adversely affecting the vibration of the diaphragm.

Embodiment 5

A loudspeaker in Embodiment 5 of the present invention will be described by illustrating the structure of a damper included in the loudspeaker with reference to FIG. 8.

Figure 8:
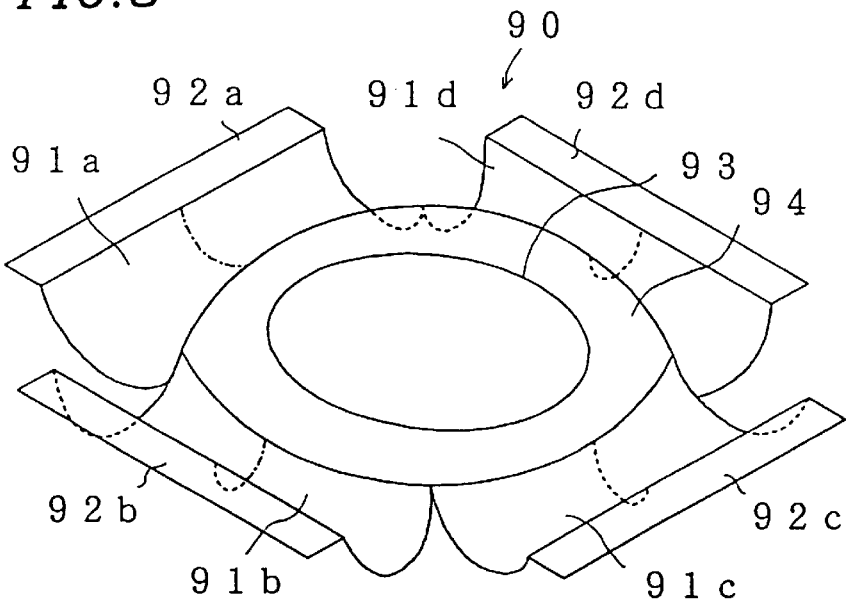
FIG. 8 is a perspective view showing a structure of a damper of a loudspeaker in Embodiment 5 of the present invention.

FIG. 8 is a perspective view showing the structure of a damper (suspension) 90 used in the loudspeaker in Embodiment 5 of the present invention.

The damper 90 is a substantially square member which includes a flat portion 94 positioned in the center, roll structures 91*a* through 91*d* (collectively denoted by the reference numeral 91) provided along a periphery of the flat portion 94, and plate-shaped attachment chips 92*a* through 92*d* (collectively denoted by the reference numeral 92) provided opposite to the flat portion 94 with respect to the roll structures 91*a* through 91*d*. The flat portion 94 has a circular hole 93 at its center for allowing a voice coil bobbin (member denoted by the reference numeral 8 in FIG. 2) to pass through. A periphery of the hole 93 of the flat portion 94 is bonded to an outer peripheral surface of the voice coil bobbin 8 with an adhesive.

In the structure of the damper 90 in the present embodiment, the roll structures 91*a* and 91*c* have an identical cross-section, and the roll structures 91*b* and 91*d* have an identical cross-section. As for each of the roll structures 91*a* through 91*d*, a radius of curvature in its cross-section gradually increases from a center to ends. As a whole, the roll structures 91*b* and 91*d* have a radius of curvature smaller than that of the roll structures 91*a* and 91*c*. Thus, the widths of grooves of the roll structures 91*b* and 91*d* are smaller than those of the roll structures 91*a* and 91*c*.

The flat portion 94 has an outer shape surrounded by four arcs, which are formed in such a manner that their radius of curvatures of edges are aligned with radius of curvatures of edges of the respective roll structures 91*a* through 91*d*. Four attachment chips 92*a* through 92*d* are attached to an attachment surface of a frame (member denoted by the reference numeral 2 in FIG. 2) so as to be positioned at an identical height with that of the flat portion 94.

The flat portion 94 and the attachment chips 92 can be formed of thin aluminum foil or kraft paper. Alternatively, the flat portion 94 and the attachment chips 92 may be integrally formed with the roll structures 91 using an identical material (e.g., natural/synthetic fibers impregnated with resin). In this case, the strength of the flat portion 94 and the attachment chips 92 is reinforced by increasing the amount of impregnating resin or by additionally bonding thin aluminum foil or kraft paper to the fibers impregnated with resin, whereby the flatness of the flat portion 94 and the attachment chips 92 is kept with respect to vibration.

The structure of the loudspeaker in the present embodiment including the damper 90 shown in FIG. 8 is substantially the same as that described with reference to FIG. 2. Therefore, the description thereof will be omitted here.

In the damper 90 having the structure as shown in FIG. 8, the cross-sectional shape of each of the roll structures 91*a* through 91*d* gradually changes in a circumferential direction of the flat portion 94, whereby winding lengths of the roll structures 91*a* through 91*d* are varied depending upon the location. Accordingly, the resonance of the damper 90 at a particular frequency determined by the shape of the roll structures 91*a* through 91*d* is dispersed at a plurality of resonance frequencies rather than at a single resonance frequency. Therefore, even when resonance is generated, the amplitude of the resonance of the damper 90 is small, not adversely affecting the vibration of the diaphragm.

Embodiment 6

A loudspeaker in Embodiment 6 of the present invention will be described by illustrating the structure of a damper included in the loudspeaker with reference to FIG. 9.

Figure 9:
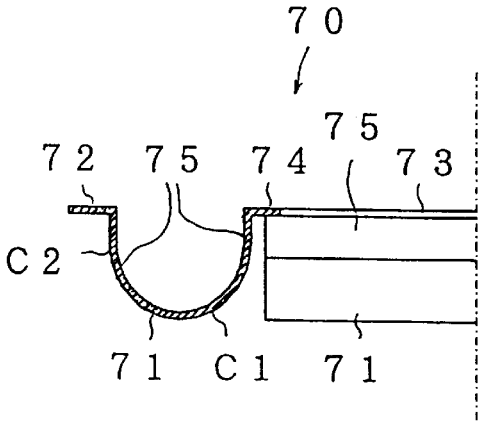
FIG. 9 is a partial cross-sectional view showing a structure of a damper of a loudspeaker in Embodiment 6 of the present invention.

FIG. 9 is a partial cross-sectional view showing the structure of a damper (suspension) 70 used in the loudspeaker in Embodiment 6 of the present invention. The damper 70 also has a flat portion 74 with a hole 73 for allowing a voice coil bobbin to pass through, and a roll structure 71 is integrally formed along a periphery of the flat portion 74. A plate-shaped attachment chip 72 is provided opposite to the flat portion 74 with respect to the roll structure 71 end attached to an attachment surface of a frame (member denoted by the reference numeral 2 in FIG. 2).

In the structure of the damper 70 in the present embodiment, the roll structure 71 has a semi-circular portion C1 and straight portions C2 which rise straight from the semi-circular portion C1. The attachment chip 72 is positioned at an identical height with that of the flat portion 74 in the same way as in the previous embodiments.

In the damper 70 having such a structure, the roll structure 71 vertically stretches and shrinks with the vibration of a diaphragm. The maximum amplitude in the stretch/shrinkage operation reaches its limit, when the roll structure 71 stretches straight. In the damper 70, the roll structure 71 is provided with the straight portions C2 as well as the semi-circular portion C1, so that the limit of the maximum amplitude becomes larger compared with the case where the roll structure 71 includes only the semi-circular portion.

Embodiment 7

A loudspeaker in Embodiment 7 of the present invention will be described by illustrating the structure of a damper included in the loudspeaker with reference to FIG. 10.

Figure 10:
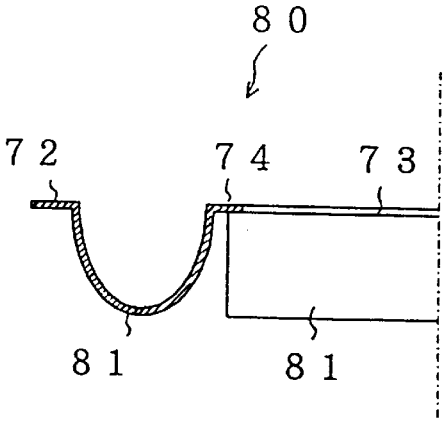
FIG. 10 is a partial cross-sectional view showing a structure of a damper of a loudspeaker in Embodiment 7 of the present invention.

FIG. 10 is a partial cross-sectional view showing the structure of a damper (suspension) 80 used in the loudspeaker in Embodiment 7 of the present invention. The damper 80 also has a flat portion 74 with a hole 73 for allowing a voice coil bobbin to pass through, and a roll structure 81 is integrally formed along a periphery of the flat portion 74. A plate-shaped attachment chip 72 is provided opposite to the flat portion 74 with respect to the roll structure 81 and attached to an attachment surface of a frame (member denoted by the reference numeral 2 in FIG. 2).

In the structure of the damper 80 in the present embodiment, the roll structure 81 has a semi-oval cross-section. Here, the long diameter of the oval is present in the vibration direction (i.e., the direction vertical to the surface of the flat portion 74 and the attachment chip 72), and the short diameter of the oval is present in the direction vertical to the vibration direction (i.e., the direction parallel to the surface of the flat portion 74 and the attachment chip 72). The attachment chip 72 is positioned at an identical height with that of the flat portion 74 in the same way as in the previous embodiments.

In the damper 80 having such a structure, the roll structure 81 vertically stretches and shrinks with the vibration of a diaphragm. The maximum amplitude in the stretch/shrinkage operation reaches its limit, when the roll structure 81 stretches straight. In the damper 80, the roll structure 81 has a semi-oval cross-section whose long diameter is directed to the vibration direction. Therefore, the limit of the maximum amplitude becomes larger, compared with the roll structure having a semi-circular cross-section. The distance between an edge of the flat portion 74 and an attachment portion of a frame (i.e., an edge of the attachment chip 72) is determined by the short diameter of the semi-oval cross-section of the roll structure 81. This distance is almost the same as a diameter of a semi-circular portion of the roll structure having a semi-circular cross-section. Thus, the diameter of the roll structure 81 required in the case of attaching the damper 80 having the structure in the present embodiment to the frame is the same as those in the previous embodiments.

Embodiment 8

A loudspeaker in Embodiment 8 of the present invention will be described by illustrating the structure of a damper included in the loudspeaker with reference to FIG. 11.

Figure 11:
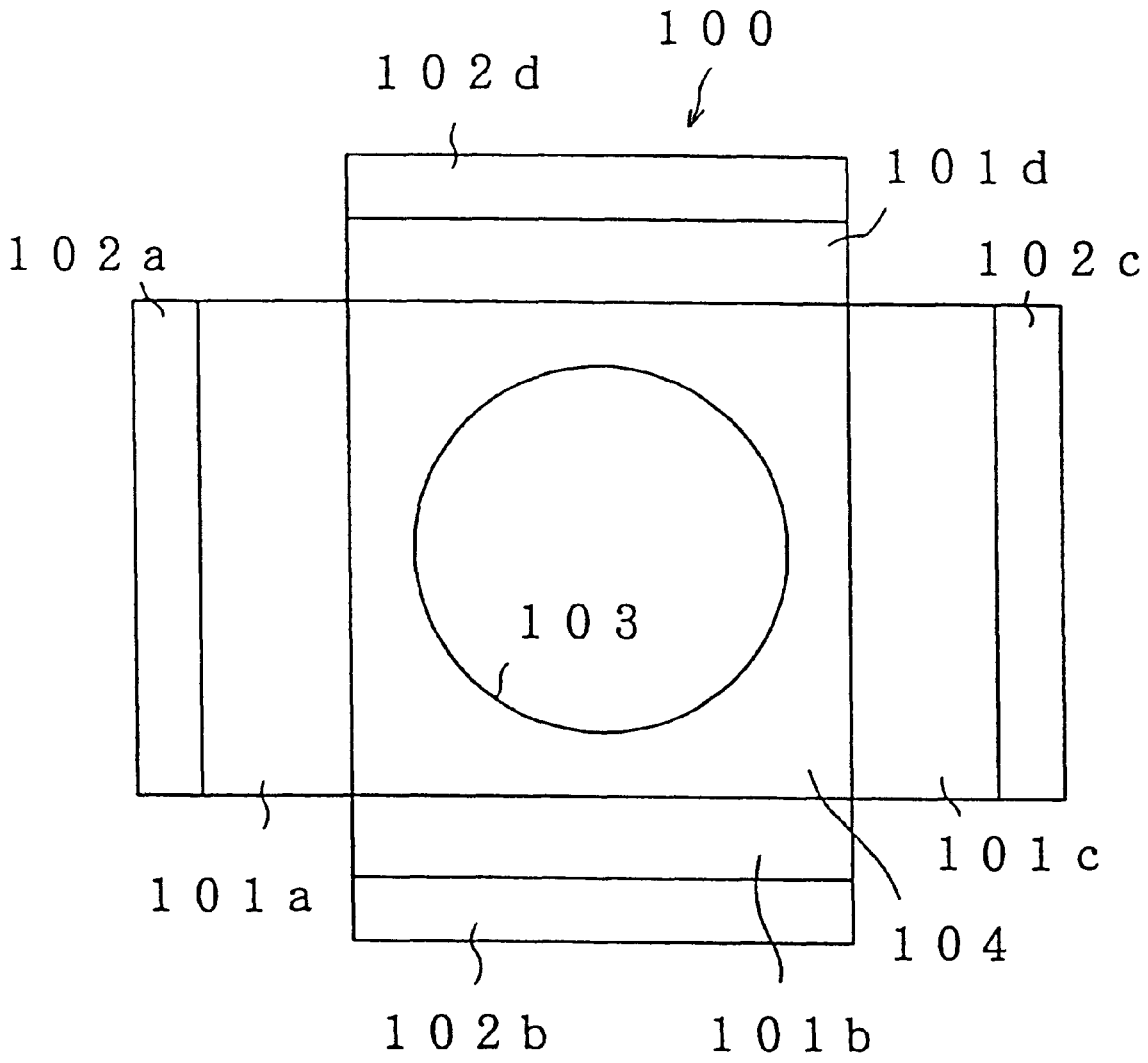
FIG. 11 is a plan view showing a structure of a damper of a loudspeaker in Embodiment 8 of the present invention.

FIG. 11 is a plan view showing the structure of a damper (suspension) 100 used in the loudspeaker in Embodiment 8 of the present invention.

The damper 100 has a flat portion 104 positioned in the center, roll structures 101*a* through 101*d* (collectively denoted by the reference numeral 101) provided along the periphery of the flat portion 104, and attachment chips 102*a* through 102*d* (collectively denoted by the reference numeral 102) provided opposite to the flat portion 104 with respect to the roll structures 101*a* through 101*d*. The flat portion 104 has a circular hole 103 at its center for allowing a voice coil bobbin (member denoted by the reference numeral 8 in FIG. 2). The periphery of the hole 103 of the flat portion 104 is bonded to the outer peripheral surface of the voice coil bobbin 8 with an adhesive.

In the structure of the damper 100 in the present embodiment, the roll structures 101*a* and 101*c* have an identical cross-section, and the roll structures 101*b* and 101*d* have an identical cross-section. As for each of the roll structures 101*a* through 101*d*, the radius of curvature in its cross-section is constant along the outer periphery of the flat portion 104. However, as a whole, the roll structures 101*b* and 101*d* have a radius of curvature smaller than that of the roll structures 101*a* and 101*c*. Thus, the widths of grooves of the roll structures 101*b* and 101*d* are smaller than those of the roll structures 101*a* and 101*c*.

Four attachment chips 102*a* through 102*d* are attached to an attachment surface of a frame (member denoted by the reference numeral 2 in FIG. 2) so as to be positioned at an identical height with that of the flat portion 104.

The flat portion 104 and the attachment chips 102 can be formed of thin aluminum foil or kraft paper. Alternatively, the flat portion 104 and the attachment chips 102 may be integrally formed with the roll structures 101 using an identical material (e.g., natural/synthetic fibers impregnated with resin). in this case, the strength of the flat portion 104 and the attachment chips 102 is reinforced by increasing the amount of impregnating resin or by additionally bonding thin aluminum foil or kraft paper to the fibers impregnated with resin, whereby the flatness of the first portion 104 and the attachment chips 102 is kept with respect to vibration.

The structure of the loudspeaker in the present embodiment including the damper 100 shown in FIG. 11 is substantially the same as that described with reference to FIG. 2. Therefore, the description thereof will be omitted here.

In the damper 100 having such a structure, the roll structure 101 vertically stretches and shrinks with the vibration of a diaphragm. The maximum amplitude in the stretch/shrinkage operation reaches its limit, when the roll structure 101 stretches straight. In the damper 100, the roll structures 101*a* through 101*d* are configures so as to have cross-sections whose maximum amplitudes are equal to each other. Therefore, the maximum amplitude is not limited by the roll structures 101*b* and 101*d* having grooves with narrow widths. The distance between the edge of the flat portion 104 and the edge of the frame attachment chip 102 is larger on the sides of the roll structures 101*a* and 101*c* and is smaller on the sides of the roll structures 101*b* and 101*d*. Therefore, there is no possibility that an area of a damper attachment region positioned at the tip end of the roll structures 101*b* and 101*d* becomes large. As a result, even when the frame becomes smaller in one direction (e.g., the short diameter direction of the oval) as in the loudspeaker using the oval diaphragm, the limit of the maximum amplitude can be increased.

Embodiment 9

A loudspeaker in Embodiment 9 of the present invention will be described by illustrating the structure of a damper included in the loudspeaker with reference to FIGS. 12 through 16.

Figure 12:
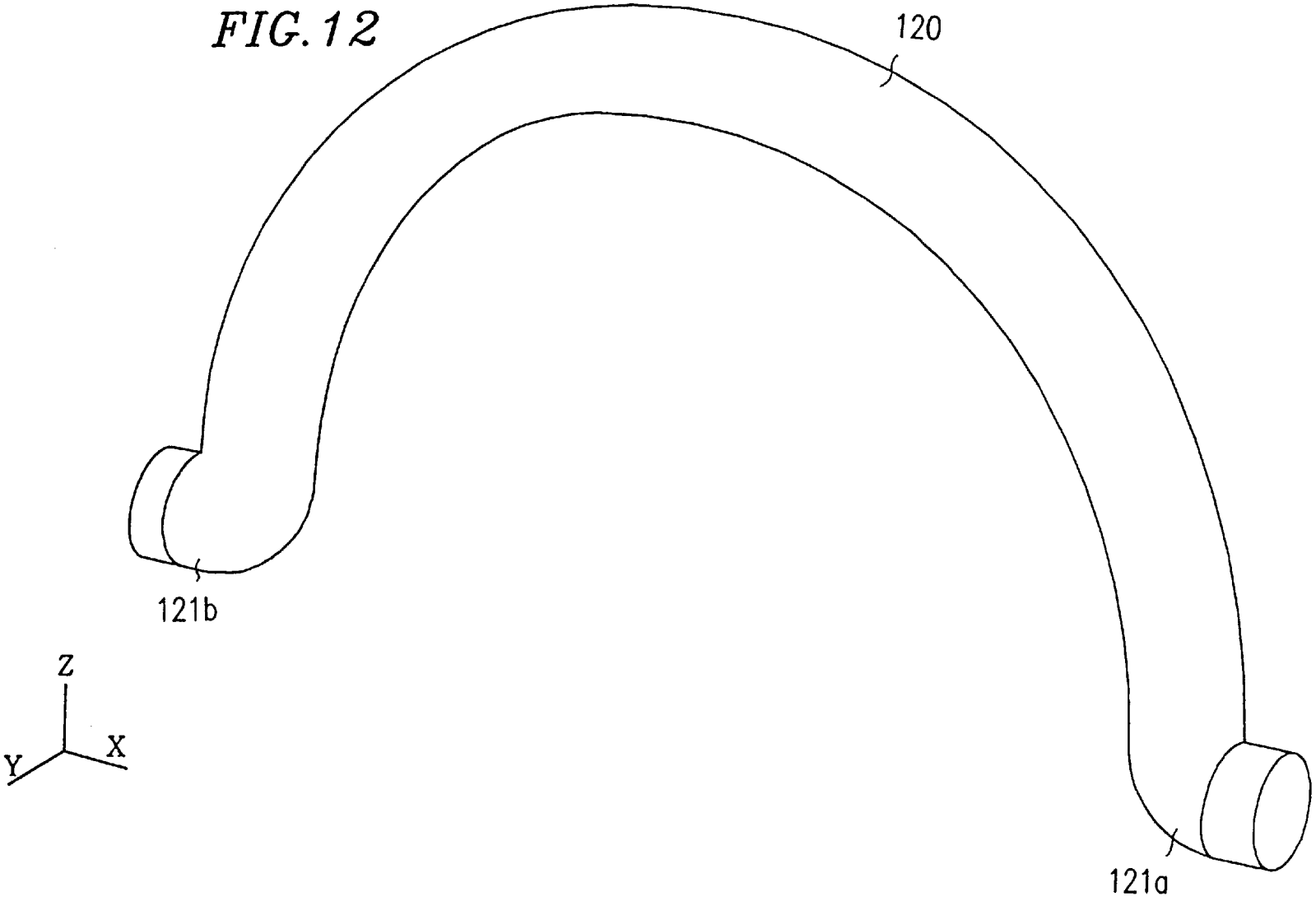
FIG. 12 is a perspective view showing a spring structure which can be used in dampers in each embodiment of the present invention.

FIG. 12 is a perspective view showing the appearance of spring member 120 forming a part of the damper used in the loudspeaker in Embodiment 9 of the present invention.

The spring member 120 is obtained by forming a wire made of cloth or thick yarn impregnated with thermosetting resin in a semi-circular shape. At both ends of the spring member 120, a voice coil bobbin attachment plate (described later) and attachment portions 121*a* and 121*b* for connecting the spring member 120 to a frame of the loudspeaker are formed. Instead of being formed in the shape of a semi-circle as shown in FIG. 12, the spring member 120 may be formed in the shape of an oval or an ollipoc (i.e., combination of a semi-circle and a straight line). Alternatively, a thin plate-shaped spring member may be used in place of the linear spring member 120.

Figure 13:
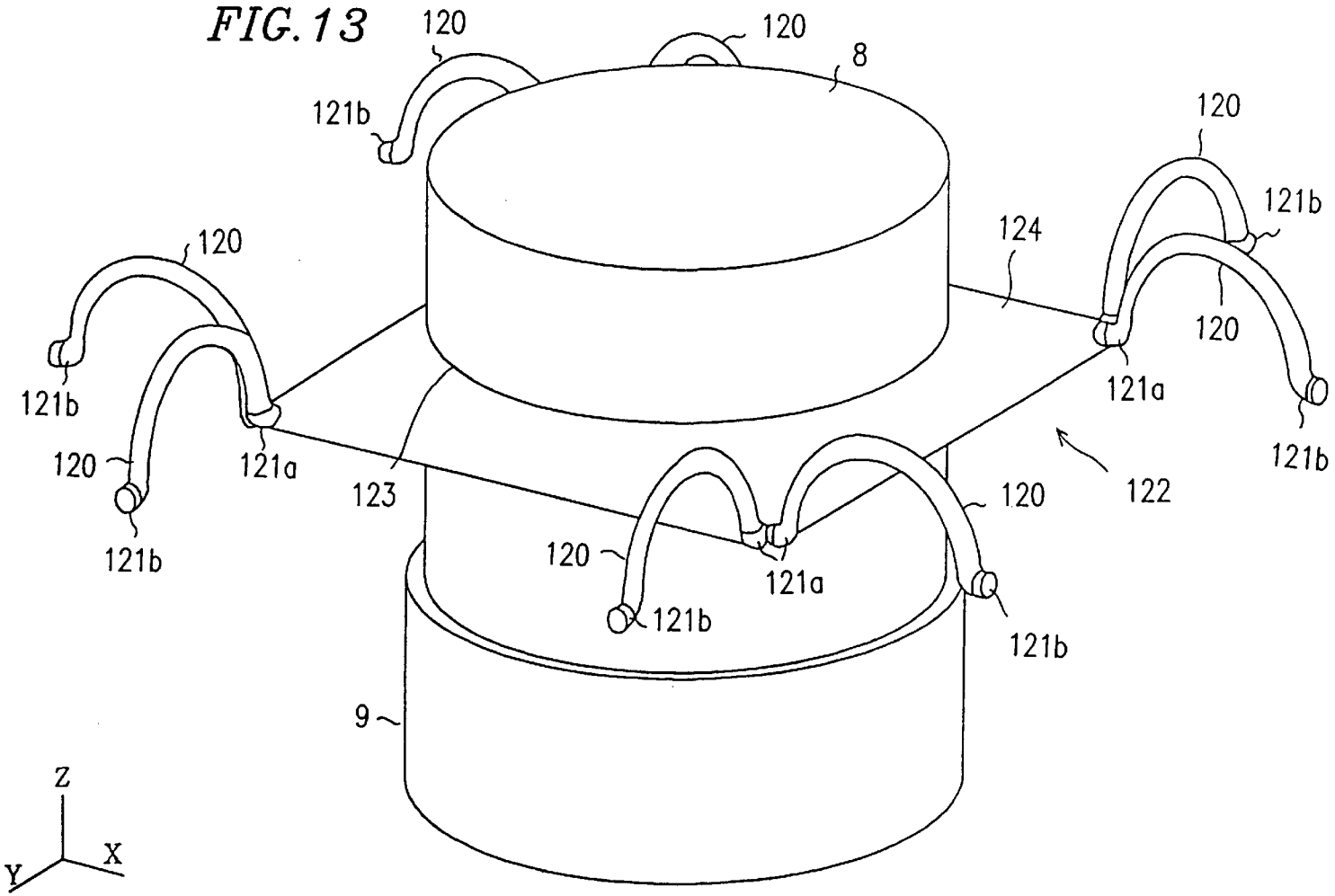
FIG. 13 is a perspective view showing a main portion of a loudspeaker in Embodiment 9 of the present invention.

FIG. 13 is a perspective view showing an appearance of a damper 122 in the present embodiment. The damper 122 includes a substantially square voice coil bobbin attachment plate 124 and spring members 120 provided at four corners of the voice coil bobbin attachment plate 124. The voice coil bobbin attachment plate 124 has such a structure as to keep flatness with respect to vibration. The voice coil bobbin attachment plate 124 can be formed of thin aluminum foil or kraft paper or has a structure in which aluminum foil or kraft paper is bonded to a thermosetting member made of cotton cloth impregnated with resin, whereby the strength of the plate is reinforced.

The voice coil bobbin attachment plate 124 has a hole 123 at its center for fixing the voice coil bobbin 8. The periphery of the hole 123 is bonded to the outer peripheral surface of the voice coil bobbin 8 with an adhesive. The spring members 120 are bonded to the voice coil bobbin attachment plate 124 at attachment portions 121*a* with an adhesive.

Assuming that the vibration direction of the voice coil bobbin 8 is the Z-axis direction, the front of the loudspeaker is positioned in the +Z direction, and the back of the loudspeaker is positioned in the −Z direction, four spring members 120 are elastic members having an identical semi-circular cross-section which is convex in the +Z direction. Attachment portions 121*b* of the spring members 120 are attached to an attachment surface of a frame so as to be positioned at an identical height with that of the voice coil bobbin attachment plate 124.

Figure 14:
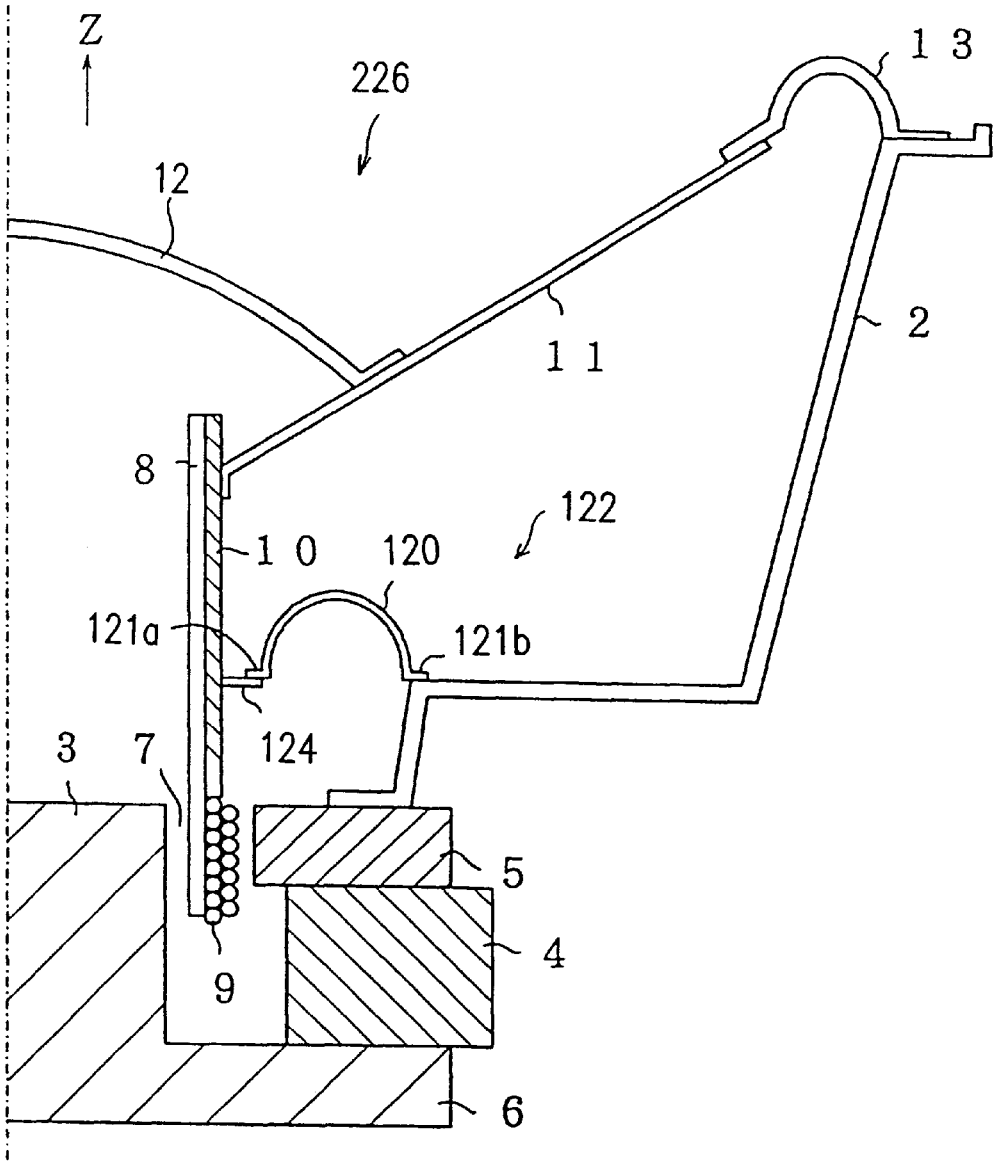
FIG. 14 is a partial cross-sectional view showing a structure of the loudspeaker in Embodiment 9 of the present invention.

FIG. 14 is a partial cross-sectional view showing a structure of a loudspeaker 226 in the present embodiment including the damper 122 shown in FIG. 13.

In the loudspeaker 226, an annular magnetic circuit 6 including a center pole 3, a magnet 4, and a top plate 5 is formed at a lower end of the annular frame 2. A high density magnetic flux is generated in an annular gap 7 formed between the upper outer periphery of the center pole 3 and the inner periphery of the top plate 5. The voice coil bobbin 8 is held by the damper 122 so as to vibrate vertically in the gap 7. The voice coil bobbin 8 is generally a member formed of thin paper in a cylindrical shape, and an outer periphery at a lower end thereof is wound with a voice coil 9.

The voice coil 9 is made of a wire such as aluminum and copper. When receiving a driving current of a sound signal, the voice coil 9 generates an electromagnetic force to vibrate the voice coil bobbin 8 vertically. The outer periphery excluding the lower end of the voice coil bobbin 8 is would with reinforcing paper 10, whereby the stiffness of the voice coil bobbin 8 is secured.

The damper 120 is directly fixed to the vicinity of a center of the voice coil bobbin 8, and a diaphragm 11 is attached to the vicinity of an upper end thereof. The diaphragm 11 is attached to the vicinity of an upper end of the frame 2 through an edge 13. Furthermore, the diaphragm 11 is provided with a cover 12 for preventing dust and the like from entering the annular magnetic circuit 6.

In the loudspeaker 226 having the above-mentioned structure, when a driving current in proportion to an intensity of a sound signal flows through the voice coil 9, the driving current and the magnetic flux in the gap 7 generate an electromagnetic force, vibrating the voice coil bobbin 8 vertically (i.e. in the Z-axis direction). This vibrates the diaphragm 11 to generate a sound. The damper 122 and the edge 13 elastically support the vibration (reciprocating motion) of the diaphragm 11.

Figure 15:
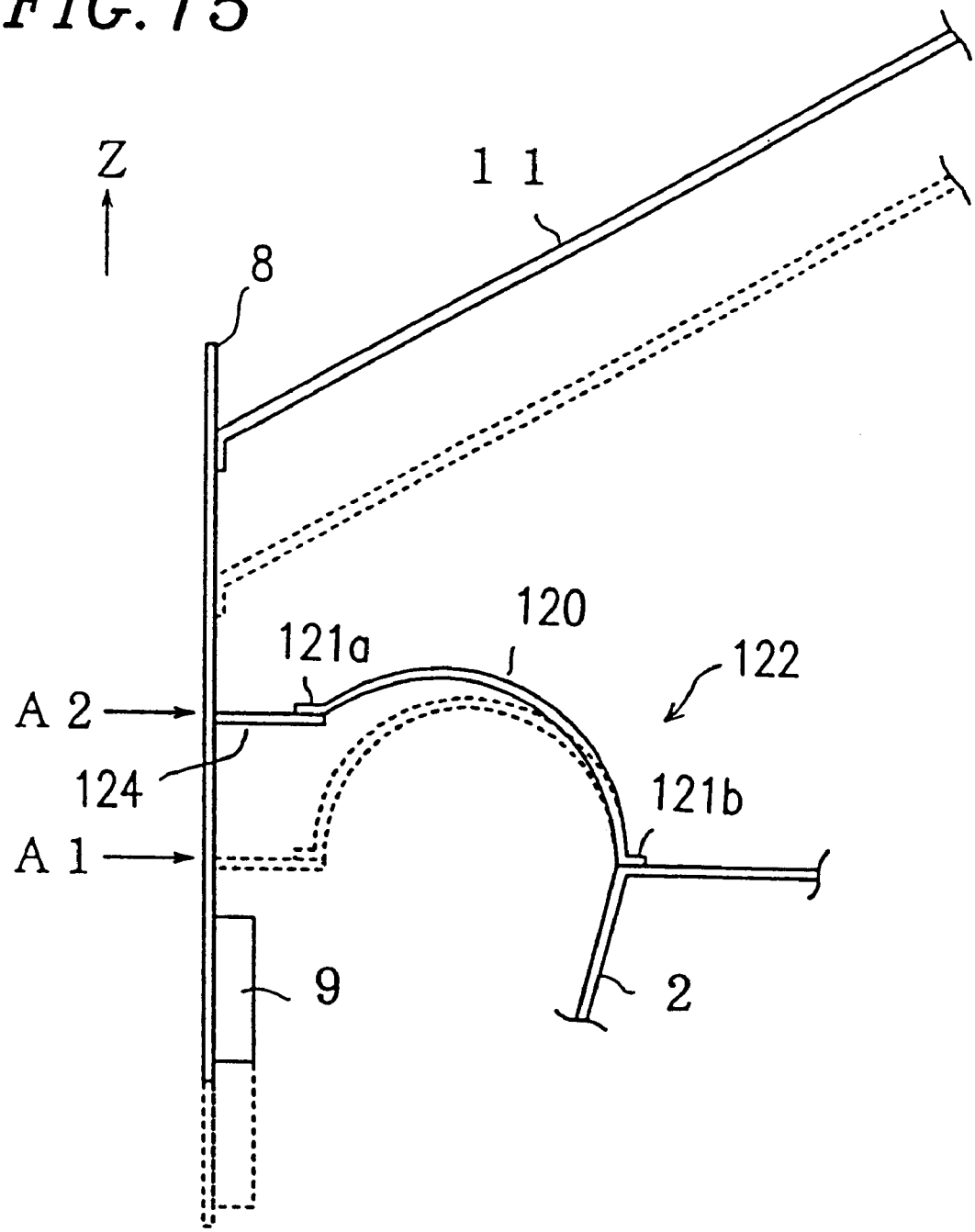
FIG. 15 is a partial cross-sectional view showing a displaced state of a damper in Embodiment 9 of the present invention.

FIG. 15 schematically shows a state of the damper 122 when a driving current is applied to the voice coil 9, and the voice coil bobbin 8 and the diaphragm 11 vibrate in the +Z direction from a state represented by a dotted line to a state represented by a solid line. The voice coil bobbin attachment portion 124 of the damper 122 is displaced integrally with the voice coil bobbin 8 as being fixed to the outer periphery of the voice coil bobbin 8. The attachment portion 121*a* positioned at one end of the spring member 120 and attached to the voice coil bobbin attachment portion 124 is displaced integrally with the voice coil bobbin 8. The attachment portion 121*b* positioned at the other end of the spring member 120 is not displaced as being fixed to the frame 2. The attachment portion 121*a* of the spring member 120 is displaced from a position A1 to a position A2 due to the vibration to support the vibration displacement of the diaphragm 11.

Herein, when seen in the Z-axis direction, the spring members 120 are disposed straight at four corners of the voice coil bobbin attachment portion 124 so as to be elastically independent from each other. Therefore, the vibration of the voice coil bobbin 8 does not involve circumferential stretch/shrinkage of a material as in the conventional corrugation damper. This allows force-displacement characteristics having outstanding linearity to be obtained, making it possible to increase the maximum amplitude of the voice coil bobbin 8.

Figure 16:
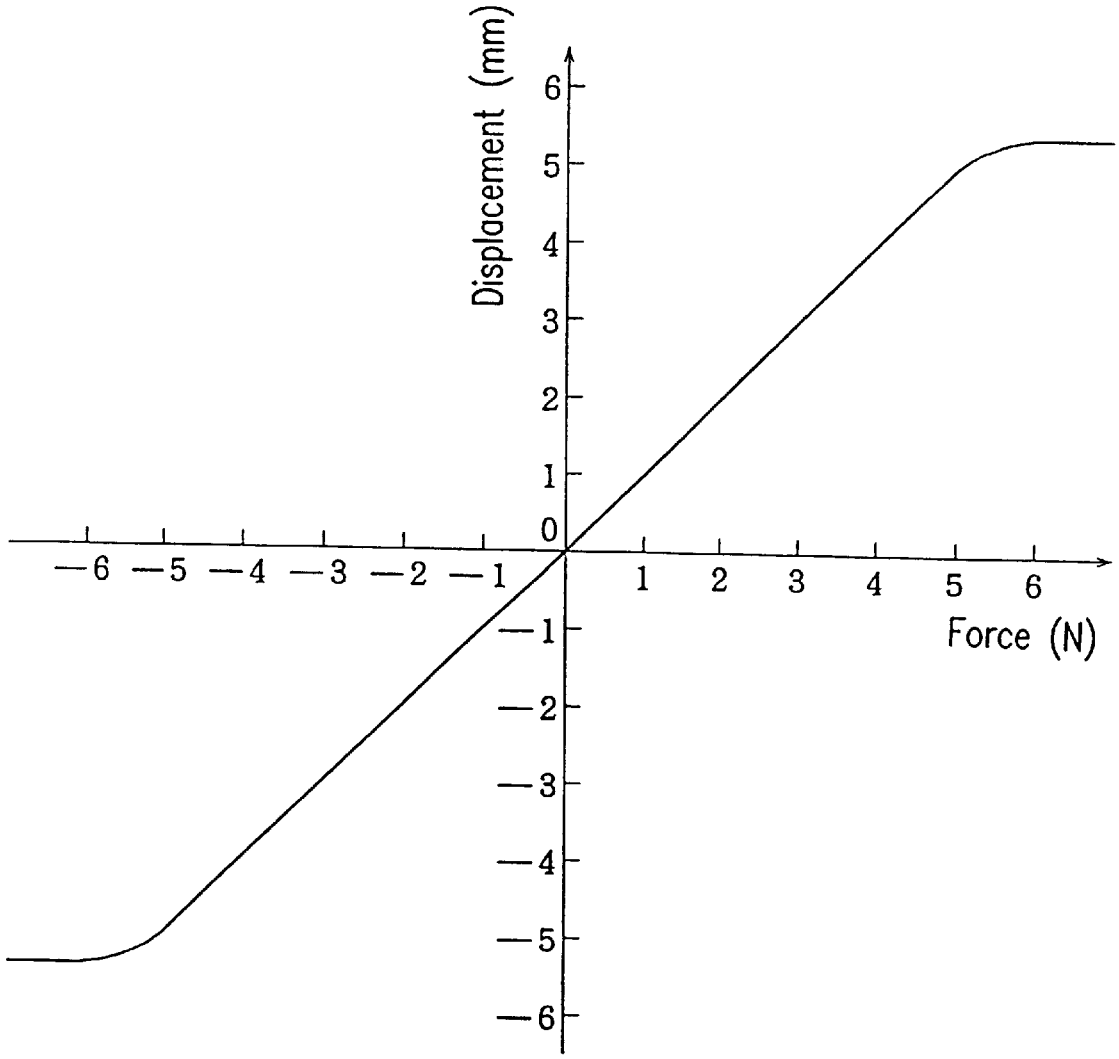
FIG. 16 shows force-displacement characteristics of the damper in Embodiment 9 of the present invention.

FIG. 16 is a graph showing force-displacement characteristics of the damper 122 in the present embodiment, i.e., one measurement example of the relationship between an electromagnetic force generated by the voice coil and the displacement amount on he innermost peripheral portion of the damper 122. As shown in this graph, the linearity of the displacement is secured in a range up to an external force of about 5 N, and the amplitude is secured in a range up to about 5 mm. Thus, both the linearity and the maximum amplitude are better than those in the conventional corrugation damper.

In the above description, the voice coil bobbin attachment plate 124 is in the shape of a square. However, the voice coil bobbin attachment plate 124 may be in the shape of a polygon (triangle or more) or a circle as long as the sufficiently large hole 123 is secured.

Embodiment 10

A loudspeaker in Embodiment 10 of the present invention will be described by illustrating the structure of a damper included in the loudspeaker.

In the present embodiment, a spring member forming a part of the damper used in the loudspeaker is obtained by forming a wire of polymer resin (i.e., a polymer wire) or a piano wire in a semi-circular shape, in place of using a wire made of cloth or a thick yarn impregnated with thermosetting resin. The other structures of the damper and the loudspeaker are similar to those in Embodiment 9. The description thereof will be omitted here.

If the spring member 120 is made of a piano wire or a polymer wire, the spring member 120 is not affected by humidity and its stiffness is not likely to vary even under high temperature and high humidity conditions, whereby bass production characteristics of the loudspeaker can be stably maintained.

Embodiment 11

A loudspeaker in Embodiment 11 of the present invention will be described by illustrating the structure of a damper included in the loudspeaker with reference to FIG. 17.

Figure 17:
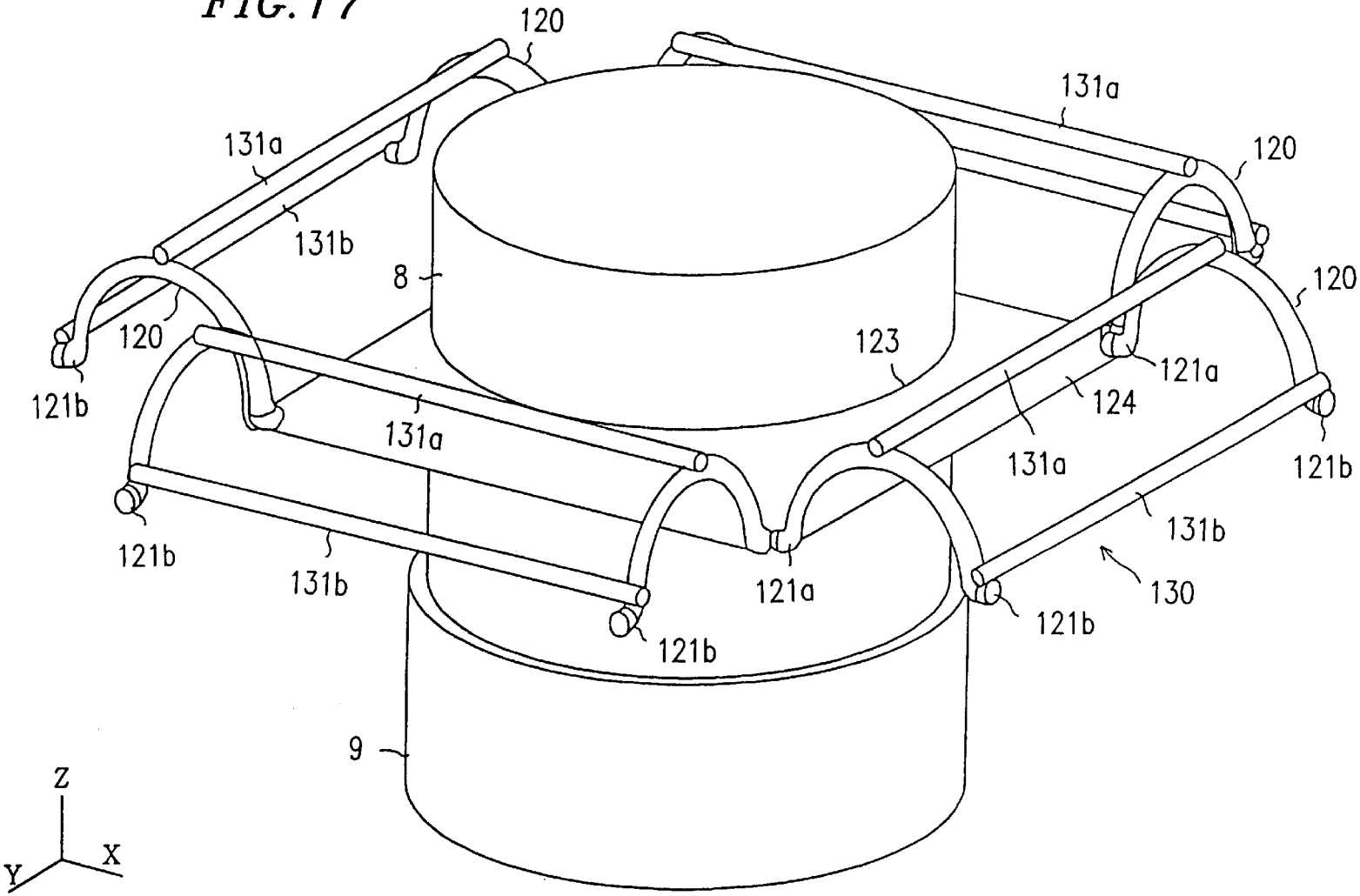
FIG. 17 is a perspective view showing a main portion of a loudspeaker in Embodiment 11 of the present invention.

FIG. 17 is a perspective view showing the structures of a damper 130 used in a loudspeaker in Embodiment 11 of the present invention. The outer shape of the damper 130 (in particular, the shape of a spring member 120) is substantially the same as that of the damper 120 in Embodiment 9 shown in FIG. 13. The damper 130 is different from the damper 120 in that connecting members 131*a* and 131*b* connecting adjacent spring members 120 are further provided. The components identical with those in FIG. 13 are denoted by the reference numerals identical with those therein, and the description thereof will be omitted here.

The damper 130 in the present embodiment includes a substantially square voice coil bobbin attachment plate 124 and spring members 120 provided at four corners of the voice coil bobbin attachment plate 124. Furthermore, straight connecting members 131*a* and 131*b* connecting a pair of spring members 120 are connected to the spring members 120 along each side of the voice coil bobbin attachment plate 124. More specifically, each connecting member 131*a* connects upper portions of the spring members 120 to each other, and each connecting member 131*b* connects attachment portions 121*b* of the spring members 120 to each other. With such a structure, the spring members 120 are not likely to be deformed in the Z-axis direction, and the vibration direction of the voice coil bobbin 8 can be defied only in the Z-axis direction.

All the spring members 120 and all the connecting member 131*a* and 131*b* can be integrally molded with elastic resin.

The voice coil bobbin attachment plate 124 has at its center a hole 123 for fixing the voice coil bobbin 8. The periphery of the hole 123 is bonded to the outer peripheral surface of the voice coil bobbin 8 with an adhesive. The spring members 120 are bonded to the voice coil bobbin attachment plate 124 at the attachment portions 121*a* with an adhesive. The attachment portions 121*b* of the spring members 120 are attached to an attachment surface of a frame so as to be positioned at an identical height with that of the voice coil bobbin attachment plate 124.

The structure of the loudspeaker in the present embodiment including the damper 130 shown in FIG. 17 is substantially the same as that described with reference FIG. 14. The description thereof will be omitted here.

The vibration characteristics of the damper 130 in the present embodiment having the structure as described above will be described.

In the damper 130, the spring members 120 are connected through the connecting members 131*a* and 131*b* on each side of the voice coil bobbin attachment plate 124. The connecting members 131*a* and 131*b* do not influence the vibration in the Z-axis direction (i.e., the vibration of the diaphragm). However, the connecting members 131*a* and 131*b* exhibit resistance to each other with respect to the deformation in the X or Y direction.

For example, when the voice coil bobbin 8 vibrates in the X direction, the connecting members 131*a* and 131*b* disposed in parallel with the X direction act so as to mainly hold the vibration system, without being easily deformed with respect to this vibration. Likewise, when the voice coil bobbin 8 vibrates in the Y direction, the connecting members 131*a* and 131*b* disposed in parallel with the Y direction act so as to mainly hold a vibration system, without being easily deformed with respect to this invention.

As a result, the connecting members 131*a* and 131*b* do not influence the vibration in the Z-axis direction which is a normal vibration direction, and resist the vibrations in the other directions, thereby preventing the voice coil bobbin 8 from rolling.

Embodiment 12

A loudspeaker in Embodiment 12 of the present invention will be described by illustrating the structure of a damper included in the loudspeaker with reference to FIGS. 18 through 19B.

Figure 18:
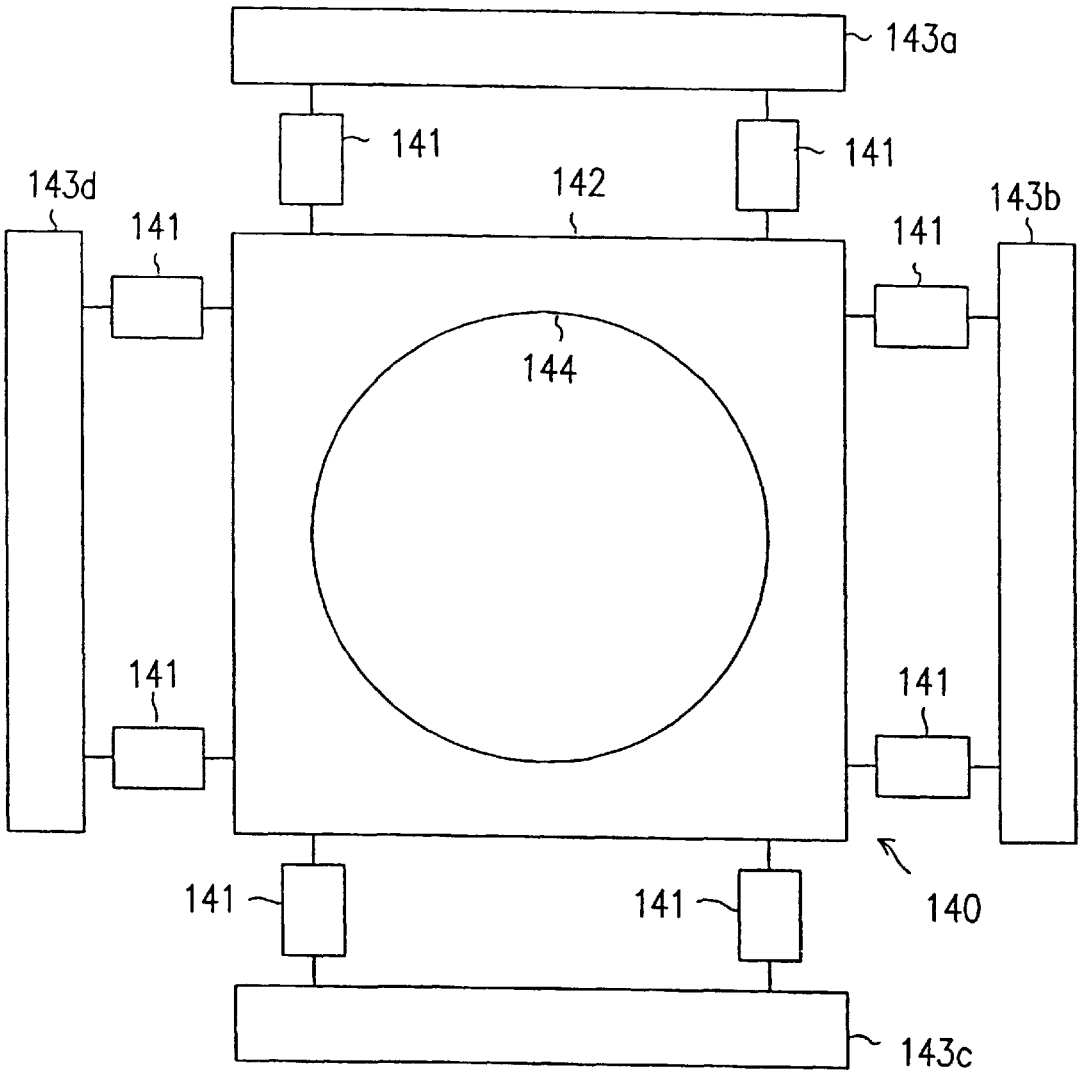
FIG. 18 is a perspective view showing a main portion of a loudspeaker in Embodiment 12 of the present invention.

FIG. 18 is a plan view showing the structure of a damper 140 used in the loudspeaker in Embodiment 12 of the present invention.

The damper 140 includes a substantially square voice coil bobbin attachment plate 142, four pairs of spring members 141 supporting each side of the voice coil bobbin attachment plate 142, and attachment chips 143*a* through 143*d* holding ends of each pair of the spring members 141 (i.e., ends opposite to the voice coil bobbin attachment plate 142). The attachment chips 143*a* through 143*d* are attached to an attachment surface of a frame so as to be positioned at an identical height with that of the voice coil bobbin attachment plate 142 in the Z-axis direction.

The voice coil bobbin attachment plate 142 has a hole 144 at its center for fixing a voice coil bobbin. The peripheral surface of the voice coil bobbin with an adhesive.

Figure 19A:
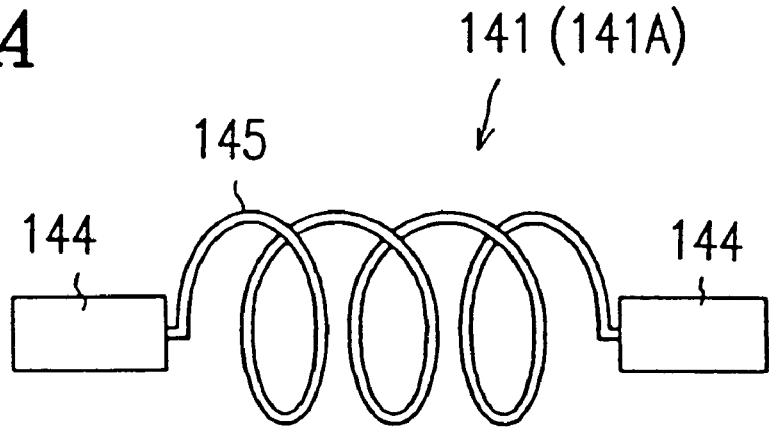
FIG. 19A is a perspective view showing an example of a structure of a spring member which can be used in a damper in Embodiment 12 of the present invention.
Figure 19B:
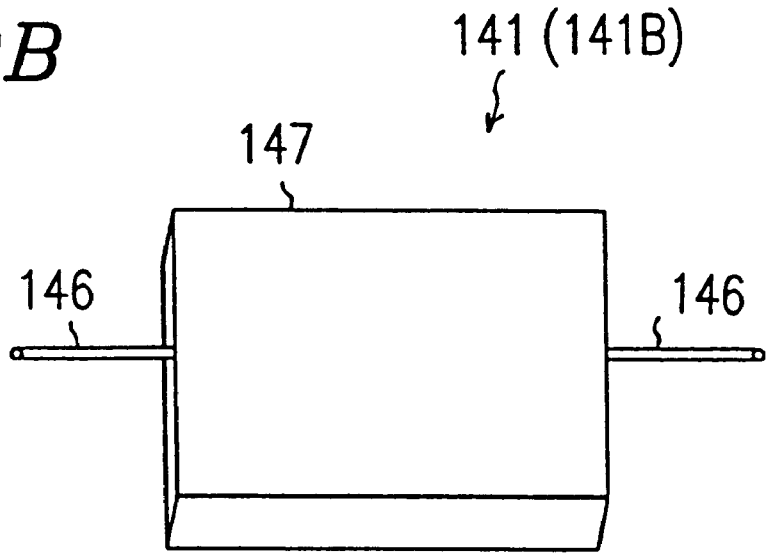
FIG. 19B is a perspective view showing another example of a structure of a spring member which can be used in the damper in Embodiment 12 of the present invention.

FIGS. 19A and 19B are perspective views each showing an example of a structure of the spring member 141.

The spring member 141 (in particular, demoted by the reference numeral 141A) shown in FIG. 19A has a structure in which a coil spring 145 made of a piano wire or a polymer wire is connected between two viscoelastic members 144. The spring member 141A is capable of easily stretching/shrinking due to the vibration of a diaphragm.

The spring member 141 (in particular, denoted by the reference numeral 141B) shown in FIG. 19B has a structure in which a viscoelastic member 147 is connected between two wires 146 made of a piano wire or a polymer wire. The wires 146 may be in the shape of a coil as shown in FIG. 19A, in place of a straight line as shown in FIG. 19B.

A material having a large loss such as polymer silicon and foam rubber is suitable for the viscoelastic members 144 and 147.

The structure of the loudspeaker in the present embodiment including the damper 140 is FIG. 18 is substantially the same as the described with reference to FIG. 14. Therefore, the description thereof will be omitted here.

The vibration characteristics of the damper 140 in the present embodiment having the structure as described above will be described.

As described with reference to FIG. 18, in the damper 140, the spring members 141 are disposed straight on four sides of the voice coil bobbin attachment plate 142 so as to be elastically independent from each other. Therefore, the spring members 141 do not involve circumferential stretch/shrinkage of the material as in the conventional corrugation damper, with respect to the vibration in the Z-axis direction of the voice coil bobbin (i.e., the normal vibration direction). Thus, force-displacement characteristics having outstanding linearity can be obtained, and the maximum amplitude of the voice coil bobbin attachment plate 142 can be increased. Furthermore, the spring members 141 are connected through viscoelastic members as shown in FIGS. 19A or 19B, so that the resonance of the damper 140 (spring member 141) itself can be prevented from being generated.

As described in Embodiment 11, the stiffness of the voice coil bobbin can be increased with respect to rolling by connecting the spring members 141 through appropriate connecting members.

Embodiment 13

A loudspeaker in Embodiment 13 of the present invention will be described by illustrating the structure of a damper included in the loudspeaker with reference to FIG. 20.

Figure 20:
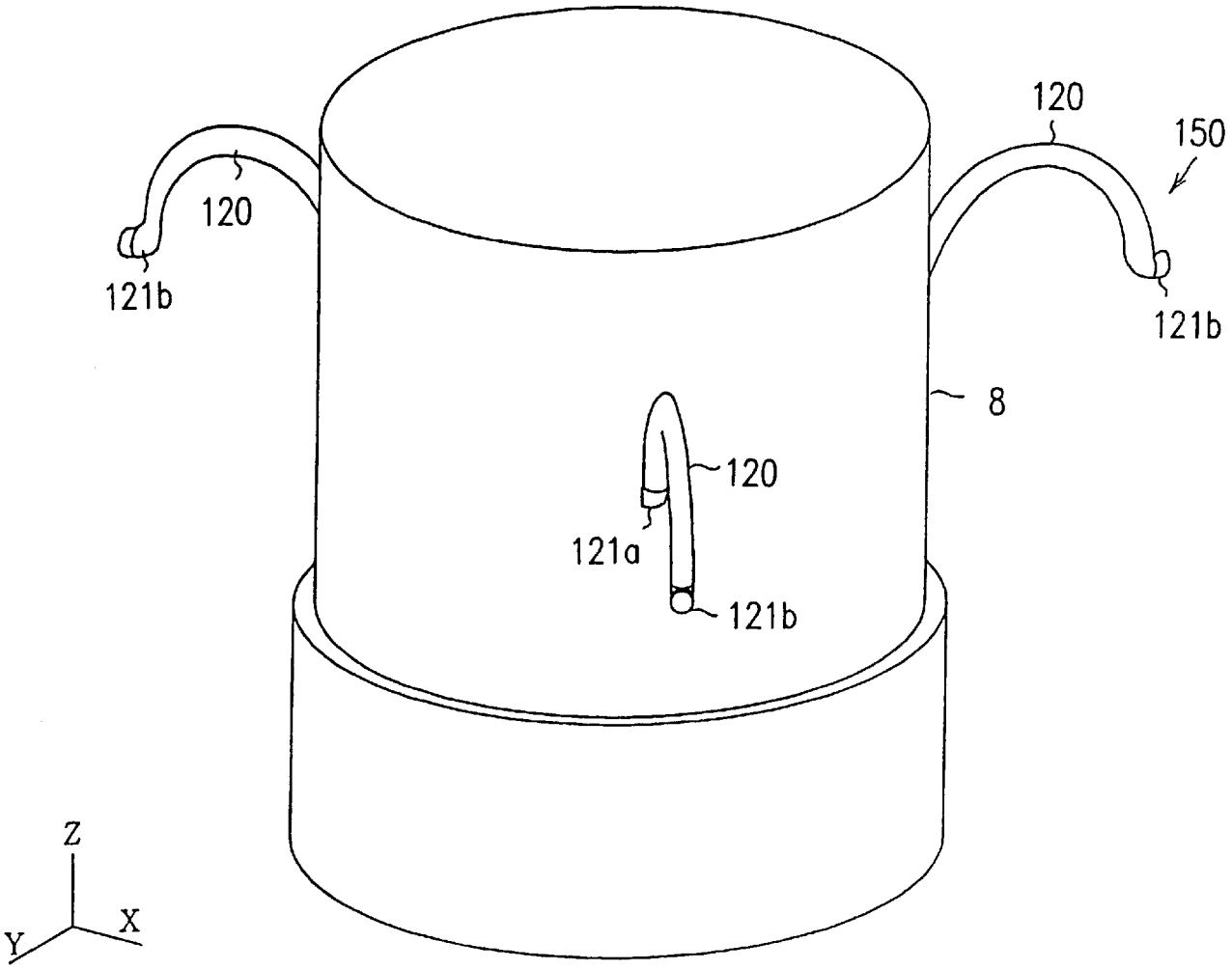
FIG. 20 is a perspective view showing a main portion of a loudspeaker in Embodiment 13 of the present invention.

FIG. 20 is a perspective view showing the structure of a damper 150 used in the loudspeaker in Embodiment 13 of the present invention. The outer shape of the damper 150 is substantially the same as that of the damper 122 in Embodiment 9 shown in FIG. 13 except that a voice coil attachment plate is not present. Because of the absence of a voice coil attachment plate, in the damper 150, attachment portions 121*a* of spring members 120 having a shape as shown in FIG. 12 are directly bonded to an outer peripheral surface of a voice coil bobbin 8. Attachment portions 121*b* of the spring members 120 are attached to the attachment surface of a frame so as to be positioned at an identical height with the attachment height of the attachment portions 121*a* and the voice coil bobbin 8.

The structure of the loudspeaker in the present embodiment including the damper 150 shown in FIG. 20 is substantially the same as that described with reference to FIG. 14. Therefore, the description thereof will be omitted here.

The vibration characteristics of the damper 150 in the present embodiment having the structure as described above will be described.

In the damper 150, the spring members 120 are radically disposed at equal intervals on the outer periphery of the voice coil bobbin 8 so as to be elastically independent from each other. Therefore, the spring members 120 do not involve circumferential stretch/shrinkage of the material as in the conventional corrugation damper, with respect to the vibration in the Z-axis direction of the voice coil bobbin 8 (i.e., the normal vibration direction). Thus, force-displacement characteristics having outstanding linearity can be obtained, and the maximum amplitude of the voice coil bobbin 8 can be increased.

Furthermore, by directly bonding the spring members 120 to the voice coil bobbin 8, the voice coil bobbin attachment plate is omitted, and the voice coil bobbin 8 can be held by at least three spring members 120. Consequently, the number of components is reduced. Thus, the damper 150 is further miniaturized and made light-weight so as to have a structure suitable for a small-sized loudspeaker.

Embodiment 14

A loudspeaker in Embodiment 14 of the present invention will be described by illustrating the structure of a damper included in the loudspeaker with reference to FIG. 21.

Figure 21:
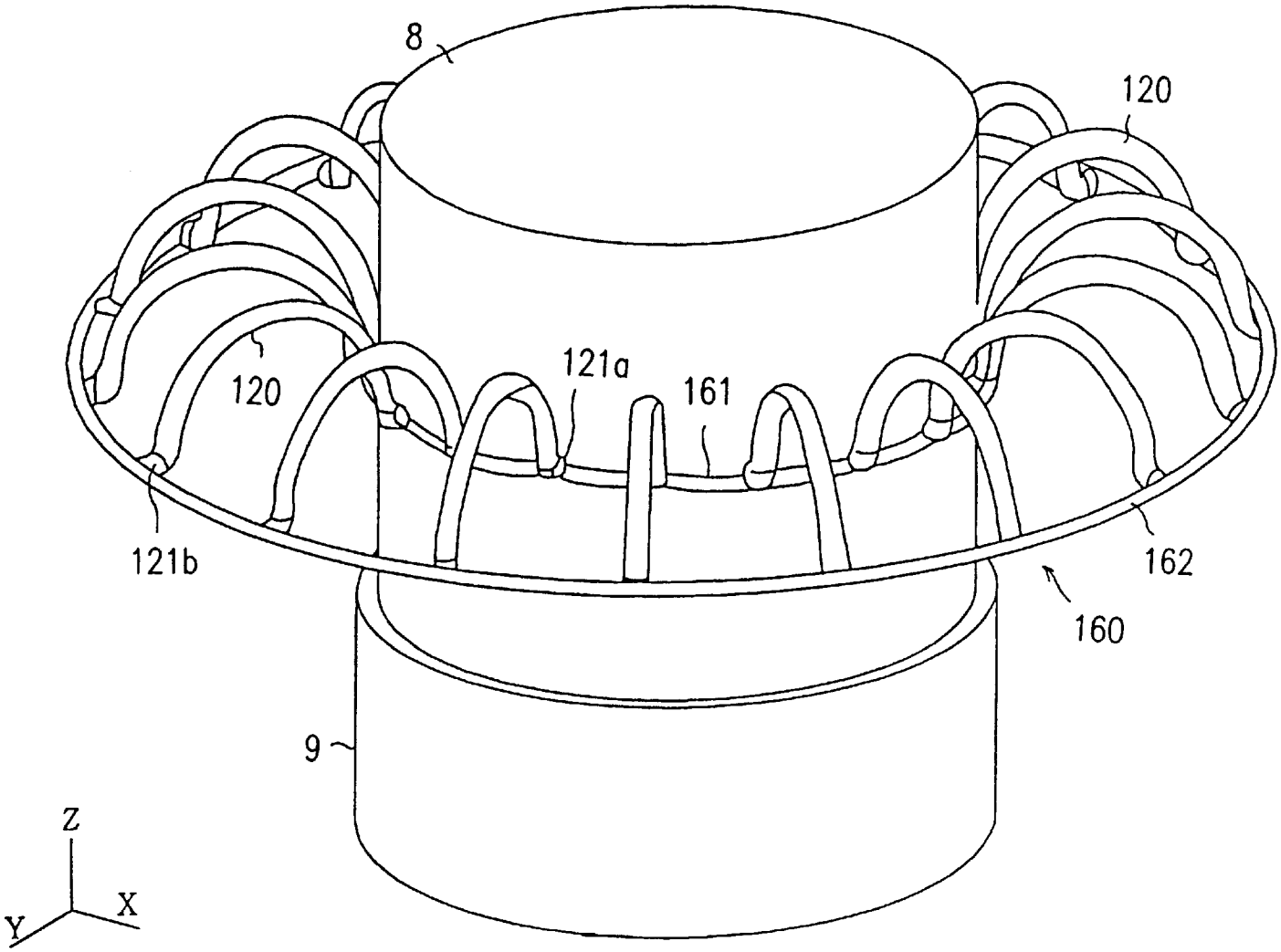
FIG. 21 is a perspective view showing a main portion of a loudspeaker in Embodiment 14 of the present invention.

FIG. 21 is a perspective view showing the structure of a damper 160 used in the loudspeaker in Embodiment 14 of the present invention.

The damper 160 includes a ring-shaped voice coil bobbin attachment portion 161, a number of spring members 120 connected to the voice coil bobbin attachment portion 161 in the shape of a petal, and a ring-shaped frame attachment portion 162 connected to the ends of the spring members 120 (the ends opposite to the voice coil attachment portion 161). The spring members 120 are connected to the voice coil bobbin attachment portion 161 and the frame attachment portion 162 at equal intervals and are bent in the +Z direction. The voice coil bobbin attachment portion 161 is connected to an outer peripheral surface of the voice coil bobbin 8, and the frame attachment portion 162 is fixed to the attachment portion of a frame (not shown in FIG. 21).

The structure of the loudspeaker in the present embodiment including the damper 160 in FIG. 21 is substantially the same as that described with reference to FIG. 14. Therefore, the description thereof will be omitted here.

The vibration characteristics of the damper 160 in the present embodiment having the structure as described above will be described.

In the damper 160, the spring members 120 are disposed at equal intervals in the form of a petal along the outer peripheral surface of the voice coil bobbin 8 so as to be elastically independent from each other. Therefore, the spring members 120 do not involve circumferential stretch/shrinkage of the material as in the conventional corrugation damper, with respect to the vibration in the Z-axis direction of the voice coil bobbin (i.e., the normal vibration direction). Thus, force-displacement characteristics having outstanding linearity can be obtained, and the maximum amplitude of the voice coil bobbin 8 can be increased.

Furthermore, the voice coil bobbin attachment portion 161 and the frame attachment portion 162 are integrated with a plurality of spring members 120 so as to be easily bonded to the voice coil bobbin 8 and the frame.

The voice coil bobbin attachment portion 161, the spring members 120, and the frame attachment portion 162 may be integrally molded with elastic resin.

Embodiment 15

A loudspeaker in Embodiment 15 of the present invention will be described by illustrating the structure of a damper included in the loudspeaker with reference to FIGS. 22 and 23.

Figure 22:
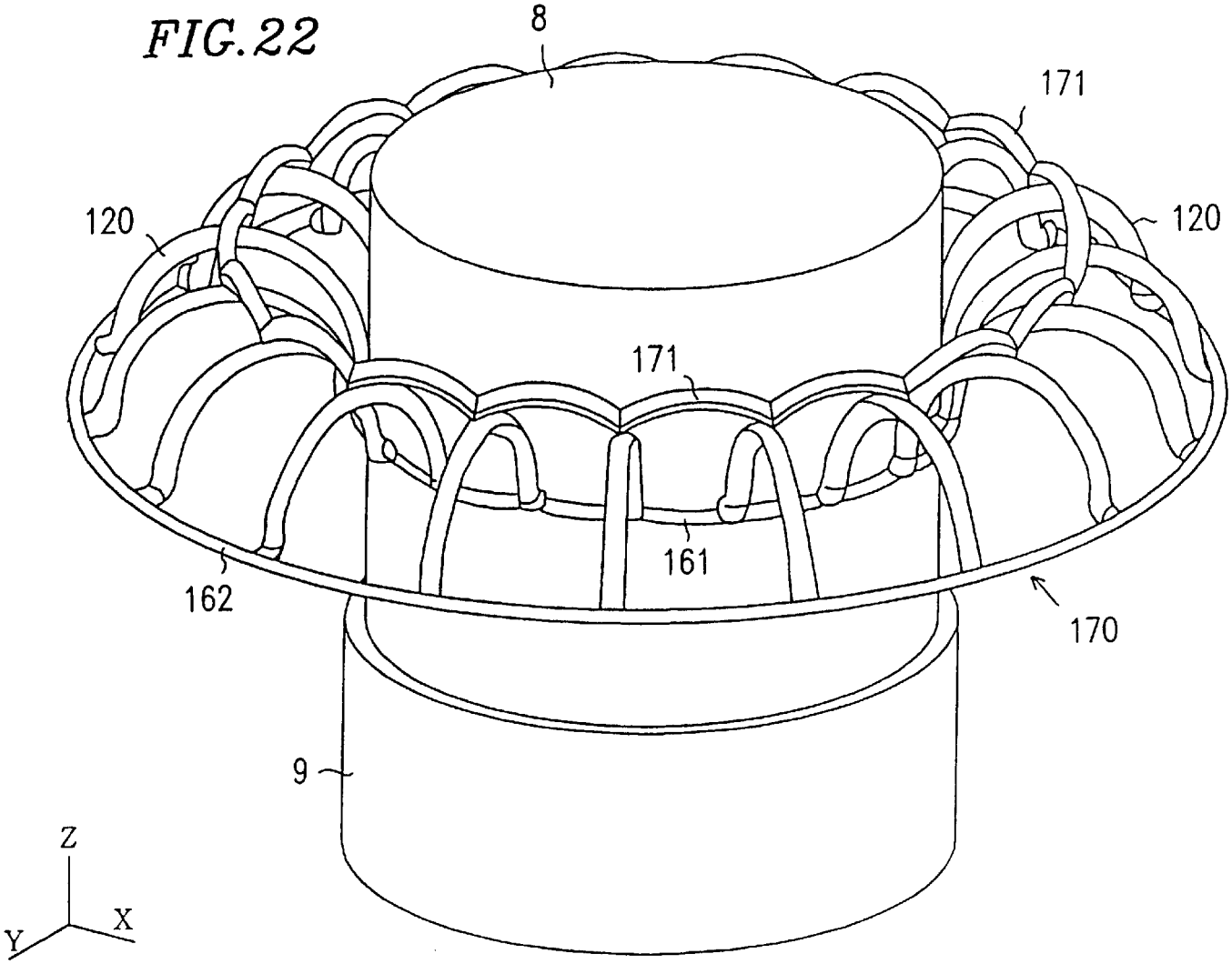
FIG. 22 is a perspective view showing a main portion of a loudspeaker in Embodiment 15 of the present invention.

FIG. 22 is a perspective view showing the structure of a damper 170 used in the loudspeaker in Embodiment 15 of the present invention. An outer shape of the damper 170 has a structure in which a connecting member 171 is connected to the spring members 120 of the damper 160 in Embodiment 14 shown in FIG. 21. The components identical with those in FIG. 21 are denoted by the reference numerals identical with those therein, and the description thereof will be omitted here.

Figure 23:
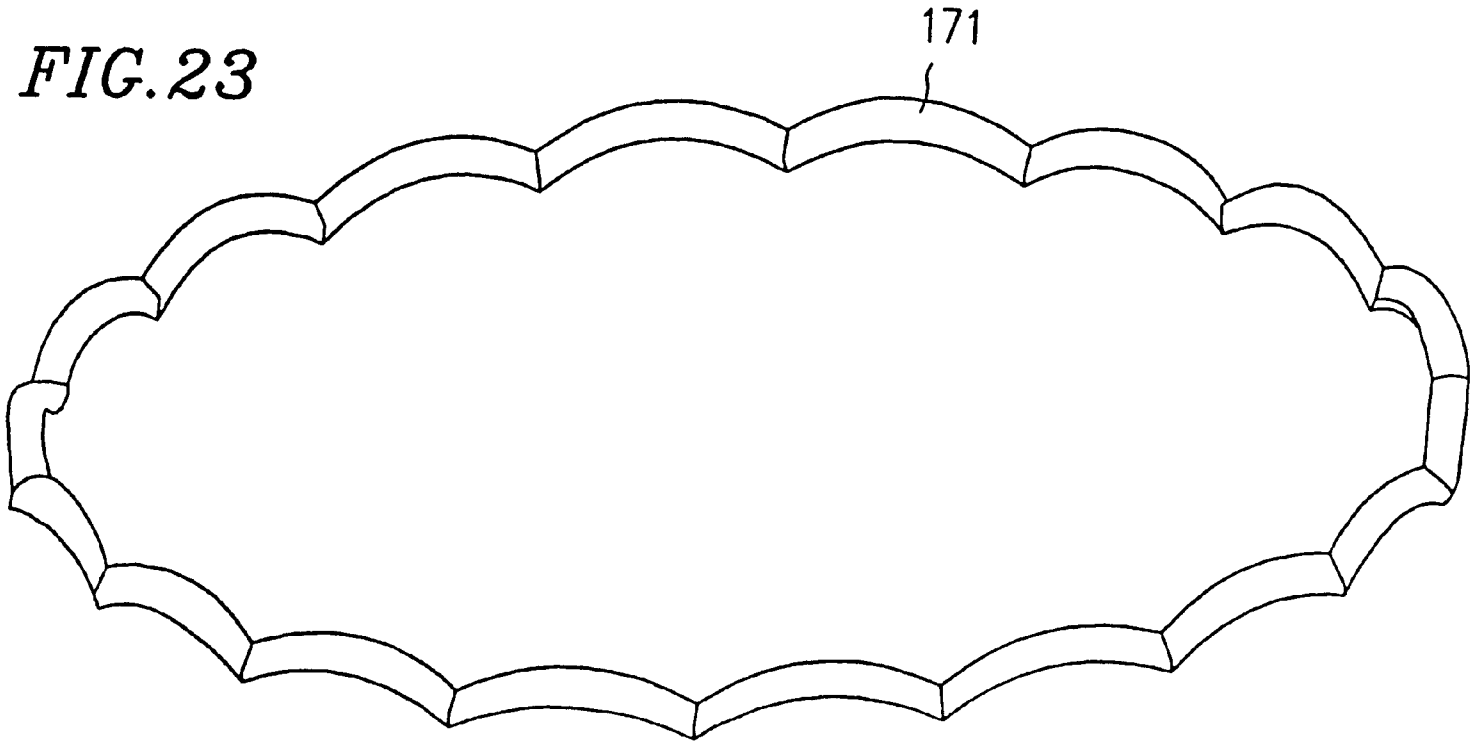
FIG. 23 is a perspective view showing a structure of a connecting member used in a damper in Embodiment 15 of the present invention.

As shown in the perspective view of FIG. 23, the connecting member 171 is a ring-shaped member in which a number of arc-shaped bendings are formed at the same repetition interval as the arrangement pitch of the spring members 120 and which is fixed to the upper portion of each of the spring members 120. The connecting member 171 can be obtained by forming a piano wire or a polymer wire into a predetermined shape.

The structure of the loudspeaker in the present embodiment including the damper 170 in FIG. 22 is substantially the same as that described with reference to FIG. 14. Therefore, the description thereof will be omitted here.

The vibration characteristics of the damper 170 in the present embodiment having the structure as described above will be described.

In the damper 170, the spring members 120 are connected to each other through the connecting member 171, so that the spring members 120 are not deformed in the circumferential direction. This prevents the voice coil bobbin 8 from rolling. The connecting member 171 is capable of easily stretching/shrinking in the circumferential direction because or their arc portions formed along the circumferential direction. Because of this, the vibration amplitude is not likely to be limited as in the conventional corrugation damper.

If the plurality of connecting members 171 shown in FIG. 23 are used to connect the spring members 120, a damper which is more stable against rolling can be obtained.

Furthermore, the voice coil bobbin attachment portion 161, the spring members 120, the frame attachment portion 162, and the connecting member 171 may be integrally molded with elastic resin.

Embodiment 16

A loudspeaker in Embodiment 16 of the present invention will be described by illustrating the structure of a damper included in the loudspeaker with reference to FIG. 24.

Figure 24:
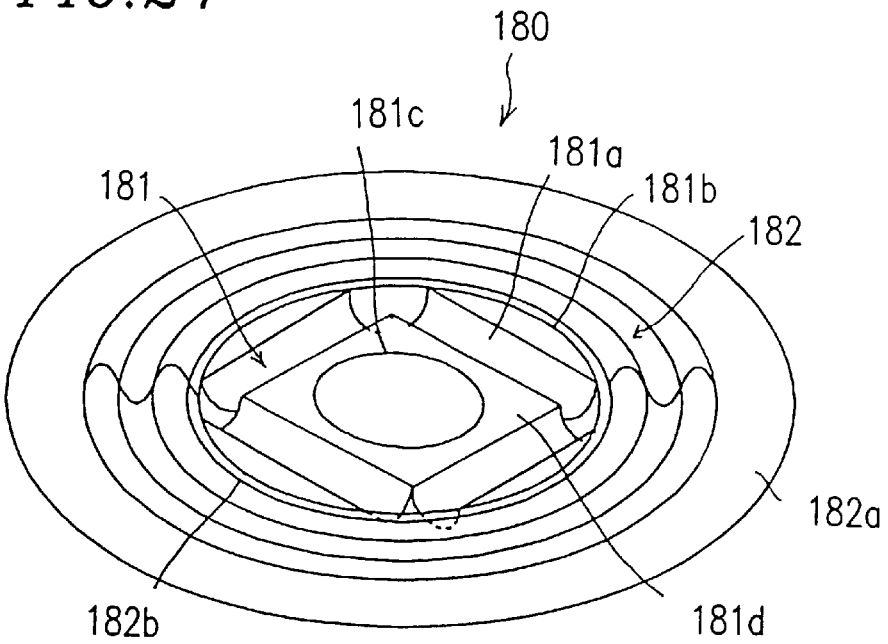
FIG. 24 is a perspective view showing a main portion of a loudspeaker in Embodiment 16 of the present invention.

FIG. 24 is a perspective view showing the structure of a damper 180 used in the loudspeaker in Embodiment 16 of the present invention. The damper 180 is a complex including a roll damper 181 having roll structures as described in the embodiments of the present invention and a corrugation damper 182 having corrugations.

Four roll structures 181*a* are formed on four sides of a square voice coil bobbin attachment plate 181*d* of the roll damper 101. Arc-shaped attachment chips 181*b* are formed on each side of the roll structures 181*a*. The corrugation damper 182 has corrugations concentrically formed. An outer peripheral portion 182*a* of the corrugation damper 182 is fixed to a frame, and an inner peripheral portion 182*b* thereof is attached to the voice coil attachment plate 181*d* of the roll damper 181. Thus, a vibration system is configured. The roll structures 181*a* and the corrugation damper 182 are integrally molded or bonded to each other with an adhesive. As the material for the dampers 181 and 182, cloth impregnated with resin, a polymer film or a thin metal foil can be used.

The vibration characteristics of the damper 180 in the present embodiment having the above-mentioned structure will be described.

In the damper 180, the roll structures 181*a* included in the roll damper 181 are attached straight to the inner peripheral portion 182*b* of the corrugation damper 182 so as to be elastically independent from each other. Therefore, the deformation of the roll structures 181*a* do not involve stretch/shrinkage of a material in the circumferential direction as in the conventional corrugation damper.

The corrugation damper 182 disposed outside has great stiffness, and its inner peripheral portion is replaced by a supporting structure having outstanding linearity. As a result, a structure which is excellent in linearity is obtained.

Because of the above-mentioned structure, the characteristics of the corrugation damper (in which force-displacement characteristics change at a mild pace) are added to the vibration characteristics of the roll structures having good linearity. Thus, a supporting system is realized, which provides vibration with outstanding linearity with respect to a small force and mildly damps an excessive input.

Embodiment 17

A loudspeaker in Embodiment 17 of the present invention will be described by illustrating the structure of a damper included in the loudspeaker with reference to FIG. 25.

Figure 25:
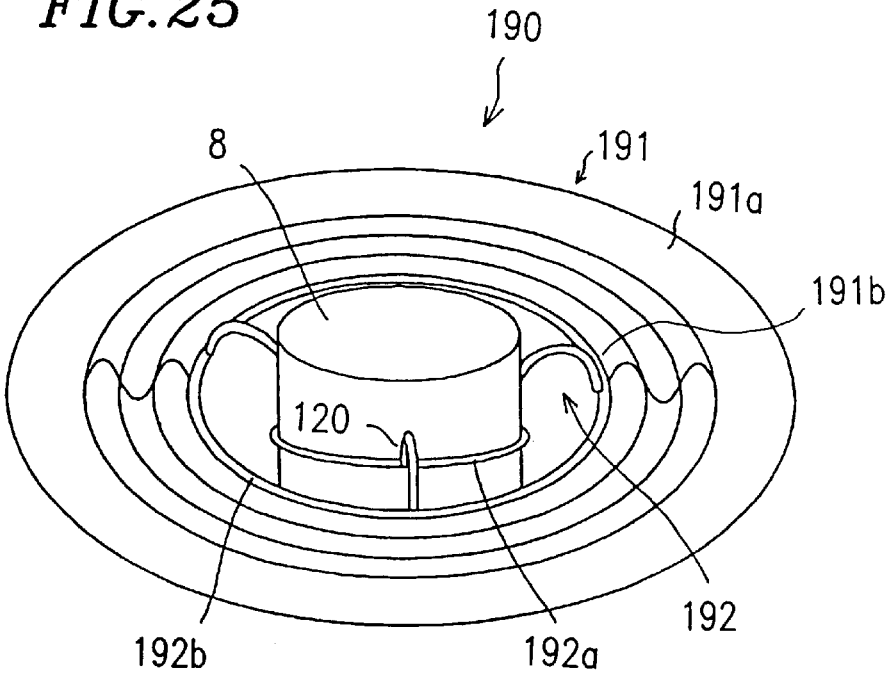
FIG. 25 is a perspective view showing a main portion of a loudspeaker in Embodiment 17 of the present invention.

FIG. 25 is a perspective view showing the structure of a damper 190 used in the loudspeaker in Embodiment 17 of the present invention. The damper 190 is a complex including a linear damper 192 having spring members 120 described in the above-mentioned embodiment of the present invention and a corrugation damper 191 having corrugations.

The corrugation damper 191 has corrugations formed concentrically. An outer peripheral portion 191*a* of the corrugation damper 191 is fixed to a frame, and an inner peripheral portion 191*b* is connected to the linear damper 192. The linear damper 192 has a structure in which the spring member 120, an inner annular member 192*a*, and an outer annular member 192*b* are connected to each other. The inner annular member 192*a* is fixed to an outer peripheral portion of a voice coil bobbin 8 and connected to the outer annular member 192*b* through a plurality of spring members 120 so as to freely vibrate.

The vibration characteristics of the damper 190 of the present embodiment having the above-mentioned structure will be described.

In the damper 190, the respective spring members 120 are disposed so as to be independent from each other. Therefore, the spring members 120 do not involve stretch/shrinkage of a material in a circumferential direction as in the conventional corrugation damper, with respect to the vibration of the voice coil bobbin 8 in the Z-axis direction. Thus, force-displacement characteristics having outstanding linearity are obtained, and the maximum amplitude of the voice coil bobbin 8 can be increased.

The corrugation damper 191 disposed outside has great stiffness, and its inner peripheral portion is replaced by a supporting structure with outstanding linearity. As a result, a structure which is excellent in linearity is obtained.

Because of the above-mentioned structure, the characteristics of the corrugation damper (in which force-displacement characteristics change at a mild pace) are added to the vibration characteristics of the roll structures having good linearity. Thus, a supporting system is realized, which provides vibration with outstanding linearity with respect to a small force and mildly damps an excessive input.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A loudspeaker, comprising:

a frame;

a magnetic circuit portion;

a diaphragm transmitting air vibration;

a cylindrical voice coil bobbin connected to the diaphragm;

a voice coil fixed to an outer peripheral portion of the voice coil bobbin; and a damper holding the voice coil bobbin in such a manner that the voice coil is capable of vibrating in a magnetic gap formed between an annular top plate and a center pole included in the magnetic circuit portion, wherein the damper includes a flat portion which has a hole for passing the voice coil bobbin therethrough at its center, the flat portion having a structure which retains its flatness with respect to vibration of the voice coil, and a plurality of roll structures connected to a periphery of the flat portion and having a cross-section including a bent periphery, with all of the plurality of roll structures included in the damper having a convex shape toward the same direction, and each of the plurality of roll structures is fixed to the frame, and the hole of the flat portion is fixed to an outer peripheral surface of the voice coil bobbin.

2. A loudspeaker according to claim 1, wherein the damper is made of natural fibers or synthetic fibers impregnated with resin, and an impregnating concentration of the resin in each of the plurality of roll structures changes from a side closer to the flat portion to a side closer to the frame.

3. A loudspeaker according to claim 1, further comprising a plurality of projections in the shape of a triangular pyramid provided along a periphery of the hole of the flat portion.

4. A loudspeaker according to claim 1, wherein a radius of the cross-section including the bent periphery of each of the plurality of roll structures changes in a central axis direction of each of the roll structures.

5. A loudspeaker according to claim 1, wherein the cross-section of each of the plurality of roll structures includes straight portions at ends of a semi-circular portion.

6. A loudspeaker according to claim 1, wherein the cross-section of each of the plurality of roll structure is in the shape of a semi-oval.

7. A loudspeaker according to claim 1, wherein the plurality of roll structures include two kinds of structures whose cross-sectional radius is different from each other, and the two kinds of structures are disposed alternatively along a periphery of the flat portion.

8. A loudspeaker, comprising:

a frame;

a magnetic circuit portion;

a diaphragm transmitting air vibration;

a cylindrical voice coil bobbin connected to the diaphragm;

a voice coil fixed to an outer peripheral portion of the voice coil bobbin; and a damper holding the voice coil bobbin in such a manner that the voice coil is capable of vibrating in a magnetic gap formed between an annular top plate and a center pole included in the magnetic circuit portion, wherein the damper includes a voice coil bobbin attachment portion fixed to the outer peripheral portion of the voice coil bobbin, and a plurality of arc-shaped spring members, one end of the spring members being fixed to the voice coil bobbin attachment portion, and the other end of the spring members being fixed to the frame, each of the plurality of arc-shaped spring members exhibits an arc in the plane of primary movement of the vibration of the voice coil, and the voice coil bobbin attachment portion has such a structure as to keep flatness thereof with respect to the vibration of the voice coil, and each of the plurality of arc-shaped spring members is made of a polymer resin or a piano wire.

9. A loudspeaker according to claim 8, wherein the damper includes:

a frame attachment portion fixed to the frame, wherein the other end of each of the plurality of spring members is fixed to the frame via the frame attachment portion in a radius direction of the voice coil bobbin.

10. A loudspeaker according to claim 9, wherein the damper further includes a connecting member connecting the plurality of spring members in a direction parallel to an outer periphery of the voice coil bobbin.

11. A loudspeaker according to claim 10, wherein the voice coil bobbin attachment portion, the frame attachment portion, the plurality of spring members, and the connecting member are integrally molded with elastic resin.

12. A loudspeaker according to claim 10, wherein the connecting member is formed with a connected plurality of arc portions having an identical pitch with an arrangement interval of the plurality of spring members.

13. A loudspeaker according to claim 8, wherein the damper further includes a connecting member connecting the plurality of spring members.

14. A loudspeaker according to claim 13, wherein the plurality of spring members and the connecting member are integrally molded with elastic resin.

15. A loudspeaker according to claim 8, wherein the arcs of the respective arc-shaped spring members exhibit a convex shape toward the same direction.

16. A loudspeaker, comprising:

a frame;

a magnetic circuit portion;

a diaphragm transmitting air vibration;

a cylindrical voice coil bobbin connected to the diaphragm;

a voice coil fixed to an outer peripheral portion of the voice coil bobbin; and a damper holding the voice coil bobbin in such a manner that the voice coil is capable of vibrating in a magnetic gap formed between an annular top plate and a center pole included in the magnetic circuit portion, wherein the damper includes a voice coil bobbin attachment plate in the shape of a polygon attached to the outer peripheral portion of the voice coil bobbin, a plurality of spring structures each being discrete from one another, one end of each being connected to the voice coil bobbin attachment plate, and attachment chips supported by the frame and connected to the other ends of the plurality of spring structures.

17. A loudspeaker according to claim 16, wherein each of the plurality of spring structures is a connected body of a viscoelastic member and an elastic member which is capable of stretching and shrinking.

18. A loudspeaker, comprising:

a frame;

a magnetic circuit portion;

a diaphragm transmitting air vibration;

a cylindrical voice coil bobbin connected to the diaphragm;

a voice coil fixed to an outer peripheral portion of the voice coil bobbin; and a damper holding the voice coil bobbin in such a manner that the voice coil is capable of vibrating in a magnetic gap formed between an annular top plate and a center pole included in the magnetic circuit portion, wherein the damper includes:

a roll damper in which roll structures having an arc-shaped cross-section and a voice coil bobbin attachment plate on a flat surface are integrally molded; and a circular corrugation damper in which a sheet having bending elasticity whose outer periphery is fixed to the frame and inner periphery is connected to the roll structures is molded in a concentric waveform.

19. A loudspeaker, comprising:

a frame;

a magnetic circuit portion;

a diaphragm transmitting air vibration;

a cylindrical voice coil bobbin connected to the diaphragm;

a voice coil fixed to an outer peripheral portion of the voice coil bobbin; and a damper holding the voice coil bobbin in such a manner that the voice coil is capable of vibrating in a magnetic gap formed between an annular top plate and a center pole included in the magnetic circuit portion, wherein the damper includes:

a circular corrugation damper in which a sheet having bending elasticity is molded in a concentric waveform;

an inner annular member and an outer annular member having different radii; and a plurality of arc-shaped spring members connecting the inner annular member to the outer annular member in a radius direction, the inner annular member being fixed to the outer peripheral portion of the voice coil bobbin, the outer annular member being connected to an inner peripheral portion of the corrugation damper, and an outer peripheral portion of the corrugation damper being fixed to the frame.

* * * * *